US006027148A

United States Patent [19]

Shoemaker

[11] Patent Number: 6,027,148

[45] Date of Patent: Feb. 22, 2000

[54] SECURITY DEVICE FOR A MOVABLE CLOSURE AND METHOD THEREFOR

[76] Inventor: Rodney Shoemaker, 2490 Saint Clair Ave., Unit No. C, Simi Valley, Calif. 93063

[21] Appl. No.: 09/097,220

[22] Filed: Jun. 12, 1998

[51] Int. Cl.[7] ..... E05C 3/06

[52] U.S. Cl. ..... 292/216; 292/201; 292/DIG. 36; 49/197; 70/DIG. 11

[58] Field of Search ..... 292/216, 201, 292/199, 280, DIG. 25, DIG. 36, 341.14; 70/256, 257, 279.1, 278.7, 283, DIG. 8, DIG. 11; 49/197, 199, 200; 160/201

[56] References Cited

U.S. PATENT DOCUMENTS

| | | | |
|---|---|---|---|
| 2,926,943 | 3/1960 | Leslie et al. | 292/216 |
| 3,664,698 | 5/1972 | Stropkay | 292/216 |
| 4,616,862 | 10/1986 | Ward | 292/201 |
| 4,703,960 | 11/1987 | Lense . | |
| 4,771,218 | 9/1988 | McGee . | |
| 4,808,995 | 2/1989 | Clark et al. . | |
| 4,819,379 | 4/1989 | Kenzelmann et al. . | |
| 4,827,667 | 5/1989 | Jarvis . | |
| 4,884,831 | 12/1989 | Emon . | |
| 4,978,153 | 12/1990 | Hirsch et al. | 292/216 |
| 4,979,384 | 12/1990 | Malesko et al. | 292/216 |
| 4,996,795 | 3/1991 | Niswonger . | |
| 5,001,861 | 3/1991 | Hahn . | |
| 5,217,266 | 6/1993 | Köstler . | |
| 5,497,641 | 3/1996 | Linde et al. | 70/257 |
| 5,544,924 | 8/1996 | Paster . | |
| 5,642,636 | 7/1997 | Mitsui | 292/216 |

FOREIGN PATENT DOCUMENTS

| | | | |
|---|---|---|---|
| 125958 | 11/1984 | European Pat. Off. | 292/216 |
| 205471 | 10/1939 | Switzerland | 292/216 |
| 635939 | 4/1950 | United Kingdom | 292/216 |
| 2142078 | 1/1985 | United Kingdom | 292/216 |

*Primary Examiner*—Teri Pham

*Attorney, Agent, or Firm*—Oppenheimer Wolff & Donnelly LLP

[57] ABSTRACT

A method and apparatus for selectively securing and unsecuring a movable closure to a support frame is provided. The security device of the present invention comprises a locking assembly attached to the frame and a securing element attached to the closure. The locking assembly comprises a first rotating element having a detent, a second rotating element being engaged with the first rotating element, and a rotating latching element being selectively engageable with the second rotating element. When the movable closure is secured, the detent of the first rotating element is securely coupled with the securing element.

22 Claims, 17 Drawing Sheets

SECURITY DEVICE FOR A MOVABLE CLOSURE AND METHOD THEREFOR

FIELD OF INVENTION

This invention generally relates to an apparatus and method for securing a movable closure, and relates in particular, to an apparatus and method for securing a movable closure such as a door to its support frame. The invention is applicable, but not limited to, movable closures that are connected to an opening mechanism which moves the closure from its closed position to an opened position, and to closures that are manually moved from their closed position to an opened position.

BACKGROUND OF THE INVENTION

A typical garage door assembly includes a solid door pivotally mounted in a door frame. From a closed position, the door can move pivotally upwardly and rearwardly to an overhead, approximately horizontal position. Another type of garage door assembly includes a garage door partitioned into several members. These several members are guided by rollers connected to a track system.

Various methods exist today for securing such garage doors to prevent any unauthorized entry by an intruder into the garage. Many residences often have a garage door secured by a padlock. These padlocks are generally located on the outside surface of the garage door and are, therefore, subject to unauthorized manipulation. Padlocks or other locks often have proven insufficient to overcome the strength and/or ingenuity of an intruder. Further, garages having garage door openers provide little security and often sacrifice security for convenience. Garage door openers comprise chain driven door openers, belt-driven door openers, and shaft driven openers and the like. Regardless of the type of garage door equipped with a garage door opener, an intruder can open such garage doors with relative ease because there is usually sufficient play in the joints, tracks, carriage, and drive connections to permit wedging of the door bottom and unauthorized entry.

Apparatuses and methods for securing garage doors are well known in the art. However, there remains a need to improve these known garage door locks. For example, the currently available garage door locks may not provide adequate security against an unauthorized entry. Other garage door locks may be overly complex and require delicate adjustments and constant maintenance in order to function reliably. Others are inconvenient in that they are not capable of being opened using a remote control, and thus do not take advantage of such technology.

OBJECT OF THE INVENTION

It is an object of this invention to provide a security device and method therefor that conveniently secures a movable closure.

It is another object of this invention to provide a security device and method therefor that conveniently secures a movable closure which is movable by a mechanical opening element.

It is yet another object of this invention to provide a security device and method therefor that conveniently secures a garage door to a garage door frame.

It is still another object of this invention to provide a security device and method therefor that conveniently secures a garage door to a garage door frame, the garage door being movable by a garage door opener which opens and closes the garage door.

It is still another object of this invention to provide a security device and method therefor that conveniently secures and is compatible with pre-existing closures, wherein the security device and method therefor is safe, reliable, easy to install and use, and inexpensive.

It is still another object of this invention to provide a security device and method therefor that conveniently secures and is compatible with pre-existing garage doors with garage door openers, wherein the security device works simultaneously and in conjunction with the existing garage door openers.

It is still another object of this invention to provide a security device and method therefor that secures a closure from unauthorized entry by using a locking gear system.

It is still another object of this invention to provide a security device and method therefor that secures a closure from unauthorized entry by using a locking bracket system.

SUMMARY OF THE INVENTION

In accordance with the present invention, a security device for securing a closure that is movable within a support frame from a secured position to an unsecured position and back is provided. The present invention achieves the objectives of preventing unauthorized entry while being safe, reliable, easily installed, and easily operated. The security device of the present invention also provides the benefits that it is capable of being operated from a remote location and that it is capable of being operated with a closure that is moved to and from its opened position by an automatic means for opening and closing the closure.

In general, the present invention achieves the foregoing objectives through the use of a locking assembly and a securing element. The locking assembly may be coupled to the support frame of the closure with the securing element coupled directly to the closure. The locking assembly may also be coupled directly to the closure with the securing element coupled to the stationary frame. The locking assembly comprises a first rotating element having a detent, a second rotating element being engaged with the first rotating element, and a rotating latching element being selectively engaged with the second rotating element. When the movable closure is secured, the detent of the first rotating element is securely coupled with the securing element. The coupling of the detent of the first rotating element with the securing element provides the ability of the present invention to secure the movable closure to its support frame, thereby preventing unauthorized entry through the movable closure.

The present invention provides a simple means for unsecuring the closure and permitting the user to move the closure from its secured position to its unsecured position. As discussed above, when the security device is in its secured position, the securing element is coupled to the first rotating element within the detent of the first rotating element. Thus, to move the securing device to its unsecured position, the securing element must be removed from the detent of the first rotating element. This is achieved by the movement of the rotating latching element and its disengagement from the second rotating element.

The rotating latching element is coupled with a spring element which forces the rotating latching element to rotate towards the second rotating element. Thus, to be disengaged from the second rotating element, the rotating latching element must be rotated against the force of the spring element. The latching element is so rotated by various means, including an actuator coupled to the rotating latching element. In this embodiment, the actuator has an actuator element which moves from a first position to a second position. This actuator element may be coupled to a wire element, which is also coupled to the rotating latching element. When the actuator is energized, the rotating latching element moves from its first position to its second position, thus causing the wire element to pull against the spring element force on the rotating latching element, causing the rotating latching element to disengage from the second rotating element. In another embodiment, the operator exerts a manual force on the rotating latching element through a manual release element.

When the rotating latching element is disengaged from the second rotating element, the first rotating element, which is also engaged to the second rotating element, becomes free to rotate. Thus, when the rotating latching element is disengaged from the second rotating element and as the closure is moved to its open position, the securing element forces the first rotating element to rotate towards its unsecured position. As the first rotating element rotates towards its unsecured position, the securing element becomes disengaged from the detent of the first rotating element, thereby freeing the securing element from the detent. The first rotating element is coupled with a spring element which forces the first rotating element to remain in the unsecured position. The closure thus becomes unsecured from its supporting frame and the user is free to move the closure to its opened, unsecured position.

The closure is moved to its closed and secured position by similar steps. When the user moves the closure to its closed position, the securing element begins to engage the detent of the first rotating element, thereby causing the first rotating element to rotate against the force of the spring element that is coupled with the first rotating element. As the first rotating element rotates, the second rotating element, which is engaged with the first rotating element, also rotates. The second rotating element has protrusions on its outer circumference, which engage a locking surface on the rotating latching element, thereby re-engaging the rotating latching element with the second rotating element, thereby locking the locking assembly and securing the securing element within the detent of the first rotating element.

In a second embodiment, the locking assembly comprises a locking element having a detent and a latching element being selectively engaged with the locking element. When the movable closure is secured, the detent of the locking element is securely coupled with the securing element. To move the securing device to its unsecured position, the securing element must be removed from the detent of the locking element. This is achieved by the movement of the latching element and its disengagement from the locking element.

The latching element is coupled with a spring element which forces the latching element to rotate towards the locking element. Thus, to be disengaged from the locking element, the latching element must be rotated against the force of the spring element. In this embodiment, the latching element is rotated by an actuator. The actuator has an actuator element which moves from a first position to a second position. This actuator may be coupled to a pivoting element, which is also coupled to the latching element. When the actuator is energized, the latching element moves from its first position to its second position, thus causing the pivoting element to pull against the spring element force on the latching element, causing the latching element to disengage from the locking element. In another embodiment, the operator exerts a manual force on the latching element through a manual release element.

When the closure is moved to its open position, the securing element forces the locking element to rotate towards its unsecured position. As the locking element rotates towards its unsecured position, the securing element becomes disengaged from the detent of the locking element, thereby freeing the securing element from the detent. The closure thus becomes unsecured from its supporting frame and the user is free to move the closure to its opened, unsecured position. The locking element is coupled with a spring element which forces the locking element to remain in the unsecured position.

The closure is moved to its closed and unsecured position by similar steps. When the user moves the closure to its closed position, the securing element begins to engage the detent of the locking element, thereby causing the locking element to rotate against the force of the spring element that is coupled with the locking element. As the locking element rotates, it re-engages with the latching element, thereby locking the locking assembly and securing the securing element within the detent of the locking element.

The present invention provides the benefits to the user of the ability to remotely operate the securing device and the ability to operate the securing device in conjunction with an automatic device for opening and closing the closure. The actuator of the present invention may be energized by an electrical signal which causes the actuator element to move from its first position to its second position. This electrical signal may come from a radio frequency remote control, as is well-known in the art. Further, the radio frequency signal may also activate an automatic opening device. Thus, when the automatic opening device is activated, the actuator of the securing device can also be activated so that the closure can be unsecured and be automatically opened with the opening device with the same remote control signal.

The security device of the present invention is intended to be used with any movable closure, however, it is particularly useful with garage doors and automatic garage door openers, as are well-known in the prior art. The present invention is thus not intended to be limited to use with garage doors or automatic garage door openers.

Other objects, features, and advantages of the present invention will become apparent from a consideration of the following detailed description.

DETAILED DISCUSSION OF THE PREFERRED EMBODIMENTS

Figure 1:
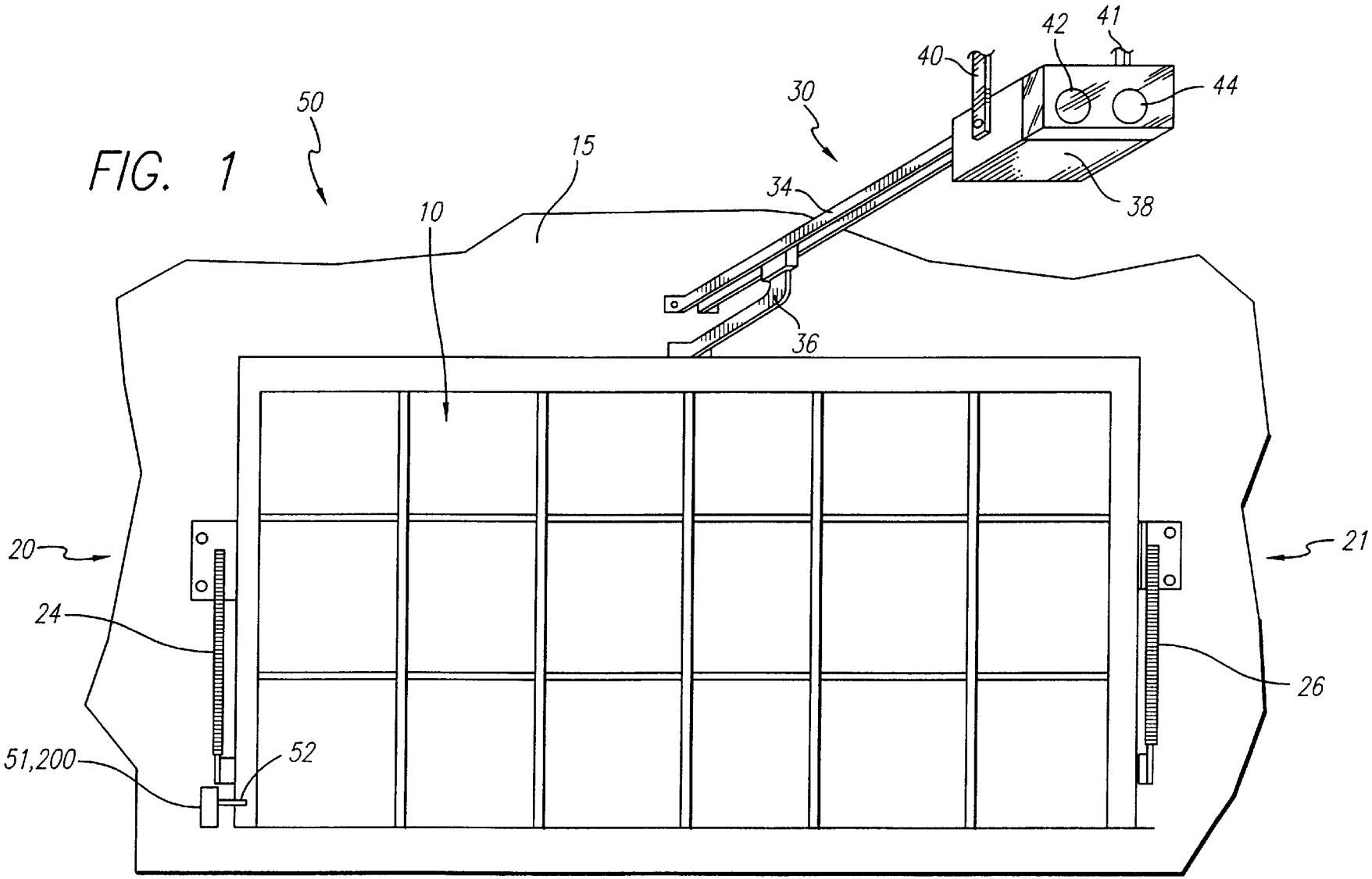
FIG. 1 is a perspective view of a typical garage door assembly with a garage door opener having the device of the present invention, the garage door being shown in the closed position.

The present invention relates to a security device for a movable closure which secures the closure to its frame and which is safe, reliable, convenient, easy to install and use, does not require major alterations to the existing opening system, does not require delicate adjustment and constant maintenance, and may even be coupled to an existing garage door opener so that it can be operated in conjunction with the garage door opener. The security device is suited for any type of closure that is supported within a stationary frame and that is moved from a closed position to an opened position and vice versa.

In the particular embodiment shown in the drawings and herein described, the movable closure is illustrated as a garage door opened and closed with a garage door opener. However, it should be understood that the principles of the invention are equally applicable to virtually any form of movable closure. Therefore, it is not intended to limit the principles of the present invention to the specific embodiments shown and such principles should be broadly construed.

Referring to FIG. 1, a garage door 10 is supported within a stationary support frame 15, the garage door 10 being a solid or single-piece assembly. The garage door 10 is mounted on the support frame by attaching pivoting side lever assemblies 20, 21 on each side of the garage door 10. The pivoting side lever assemblies 20, 21 are mounted on opposite sides of the support frame, and include counterbalancing springs 24, 26. As a result, the garage door 10 can be pivoted upwardly from a vertical closed position as shown FIG. 1 to an overhead horizontal position (not shown). Many other types of garage door assemblies exist such as a garage door assembly comprising a garage door partitioned into several members and guided by rollers connected to a track system. The present invention is intended to work equally well with either type of garage door or closure.

In accordance with the present invention, the closure may be opened and/or closed automatically using an automatic opening device, such as an electric garage door opener. It is not intended that the present invention be limited to closures having such opening devices—the present invention is intended to operate with both closures that include and do not include such openers.

A garage door opener 30 can comprise any of several designs, including chain driven door openers, belt-driven door openers, and shaft driven openers and the like (see FIG. 1). The garage door opener 30 shown herein includes a guide track 34 mounted-on the horizontal portion of the support frame 15 with a chain (not shown) rotatably coupled about the length of the guide track 34. An opener arm 36 is slideably coupled at one end with the guide track 34 and driven by the chain. At the other end, the opener arm 36 is connected to the garage door 10. The garage door opener 30 also includes a housing 38 which is suspended by housing members 40, 41 attached to the ceiling of the garage (not shown). The housing 38 is also affixed to the end of the guide track 34 which is opposite the support frame 15. The housing 38 contains a controller 42 and an electric motor 44, wherein the controller 42 controls the electric motor 44. A signal can be sent to the controller 42 to either open or close the garage door 10 by an interior switch electrically coupled to the controller 42 with a wire, or by a remote switch coupled to the controller 42 via a radio frequency signal (see FIG. 17). Typically, the interior switch is a garage door opener button located on the garage door wall, and the remote switch is generally a remote opener carried in a motor vehicle. The electric motor 44 drives the chain, and the chain slides the opener arm 36 in a manner which opens and closes the garage door 10.

The operation of closing and opening the garage door 10 is as follows (see FIG. 1). When the garage door 10 is in the closed position, an operator engages either the garage door opener button or the remote opener, and a signal is sent to the controller 42 to energize the electric motor 44. The electric motor 44 slides the opener arm 36 along the guide track 34 and away from the support frame 15. The opener arm 36 carries the garage door 10 upwardly and away from the support frame 15 in a pivotal motion to a horizontal open position where the garage door opener 30 automatically stops. The operator can close the garage door 10 by engaging the garage door opener button or the remote opener. The garage door opener 30 will operate in a reverse manner, such that the electric motor 44 slides the opener arm 36 along the guide track 34 and toward the support frame 15. The opener arm 36 lowers the garage door 10 downwardly and toward the support frame 15 in a pivotal motion to a vertical closed position where the garage door opener 30 automatically stops. A subsequent actuation may reversibly actuate the garage door opener 30.

One of the principal problems of conventional garage door openers 30, such as the one described above, is the unauthorized opening of the garage door 10 without electrically actuating the garage door opener 30. In other words, the conventional garage door opener 30 can be overpowered by someone manually pulling the door open 10 from the outside. This means that security is compromised for the convenience of the garage door opener 30.

In order to further secure the garage door 10 in its closed position, the security device 50 of the present invention is provided. The security device 50 has a locking assembly 51. The locking assembly 51 can be mounted at any point along the support frame 15. In FIG. 1, the locking assembly 51 is shown mounted on the vertical portion of the support frame 15. If additional security is desired, more than one locking assembly 51 can be mounted to the support frame 15. There is a corresponding securing element which is shown in the drawings as a rod 52 attached to the side edge of the garage door 10 which can be selectively secured and unsecured by the locking assembly 51. Therefore, the garage door 10 is secured when locking assembly 51 secures the rod 52, and the garage door 10 is unsecured when the locking assembly 51 unsecures the rod 52. The securing element can be configured in various forms, such as a rod 52, as long as it is able to engage and disengage with the locking assembly 51. It is not necessary that the locking assembly 51 be attached to the support frame 15 and the rod 52 be attached to the garage door 10—these may be reversed in accordance with the present invention, so that the locking assembly 51 is attached to the garage door 10 and the rod 52 is attached to the support frame 15.

Figure 2:
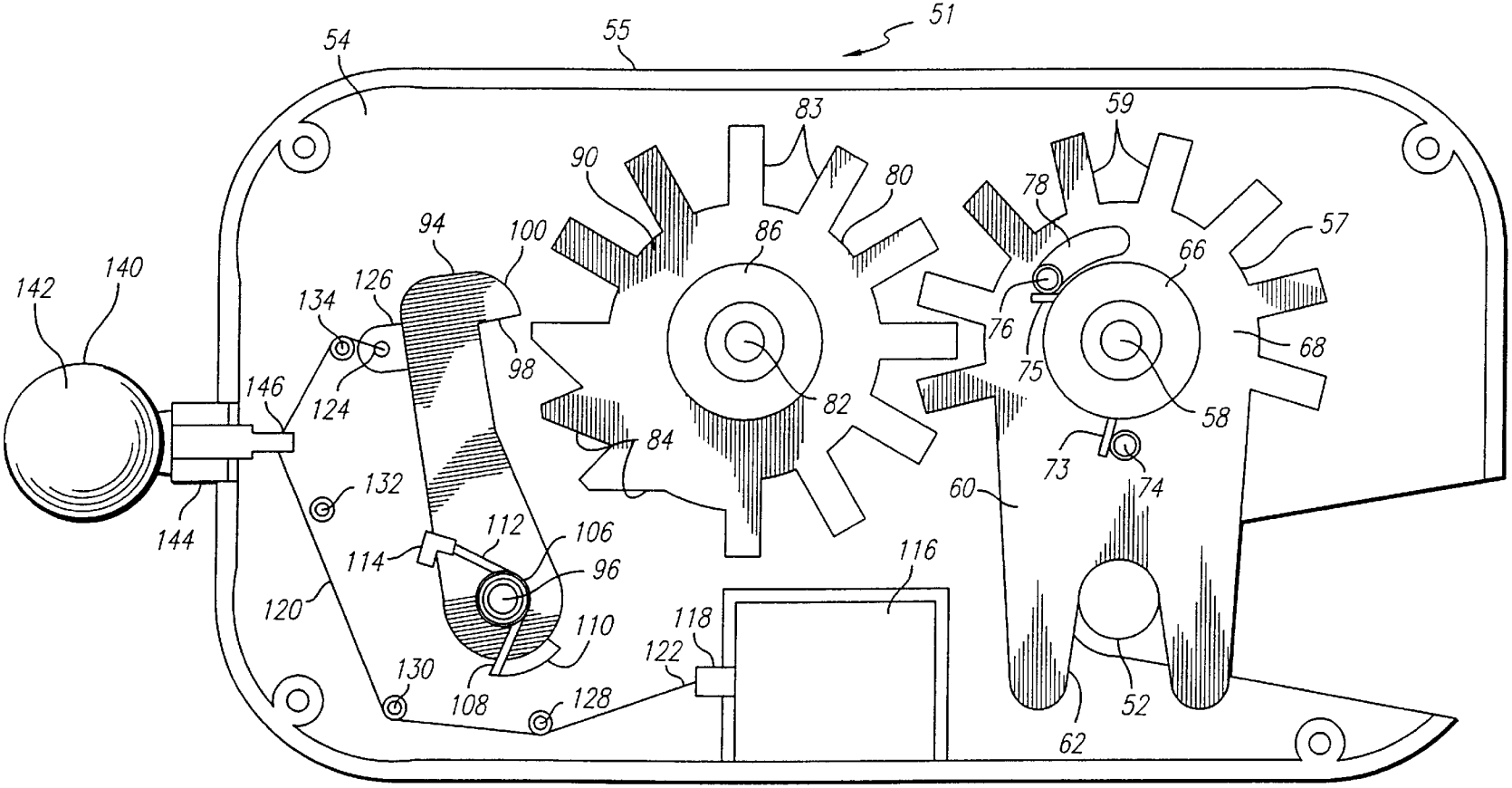
FIG. 2 is a close-up top view of the security device in its unsecured position with the garage door closed and about to be opened.
Figure 3:
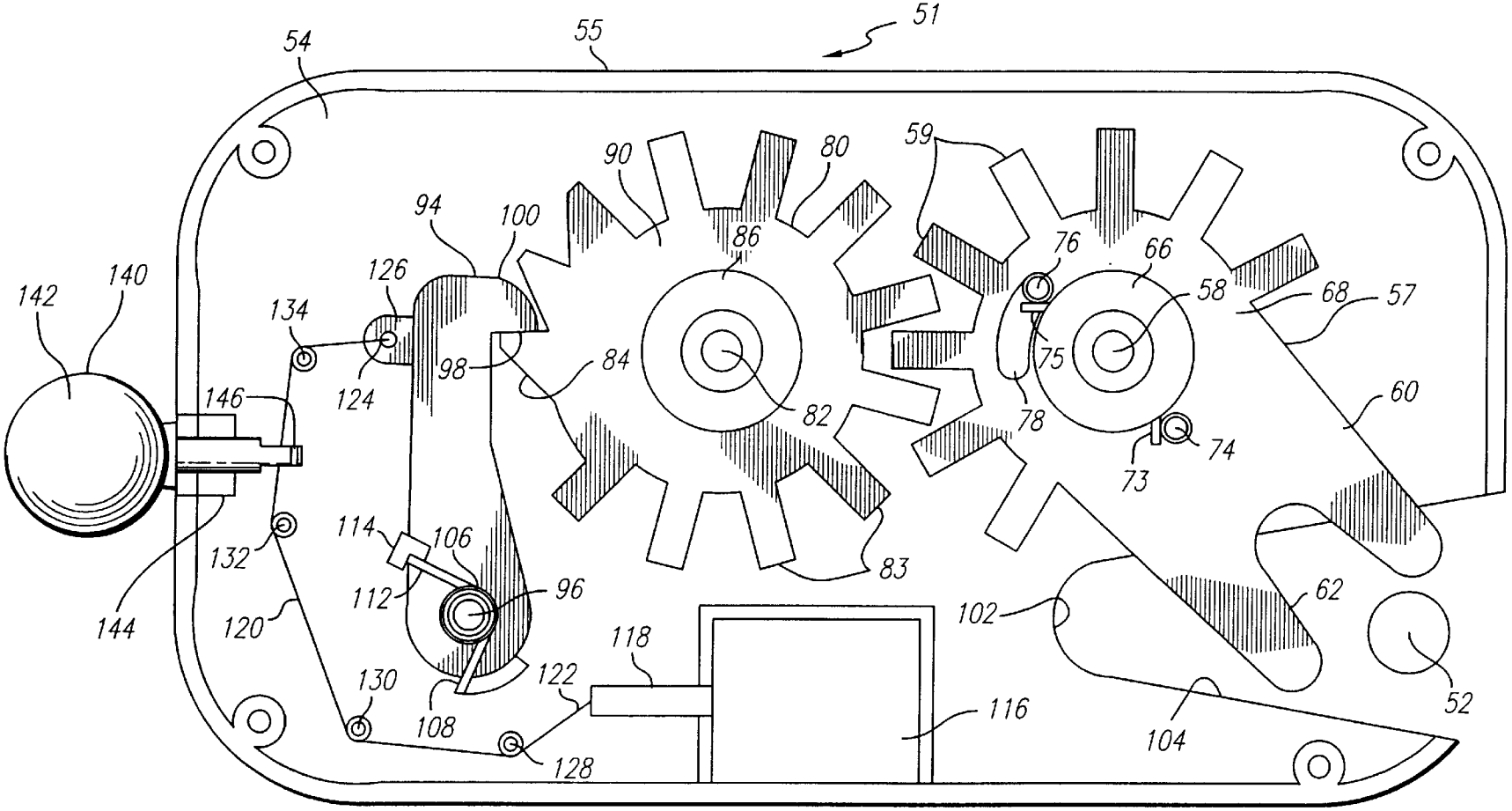
FIG. 3 is a close-up top view of the security device of the embodiment of the present invention shown in FIG. 2 in its secured position with the garage door opened and about to be closed.
Figure 4:
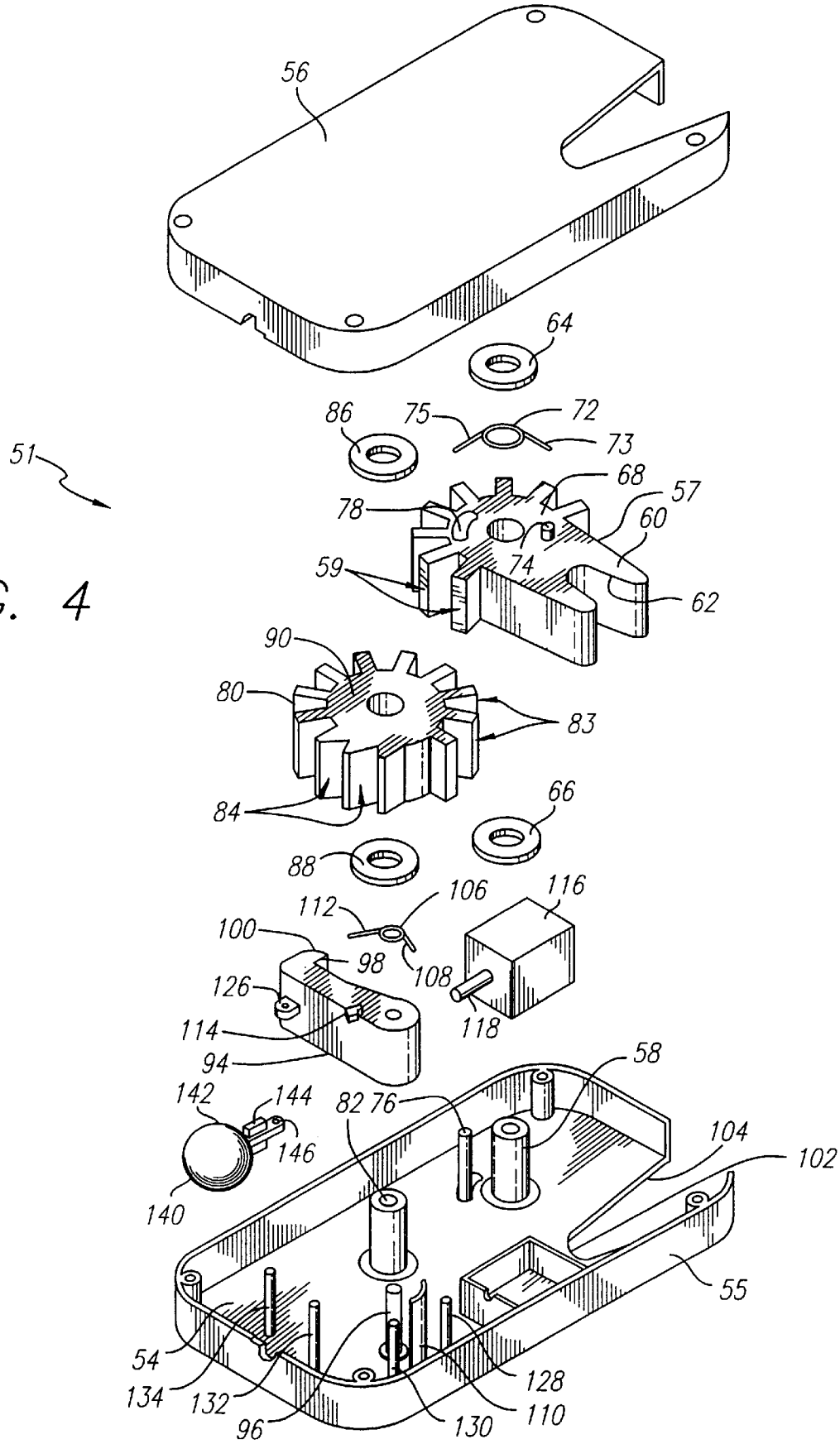
FIG. 4 is an exploded view of the security device of the embodiment of the present invention shown in FIGS. 2 and 3.
Figure 5:
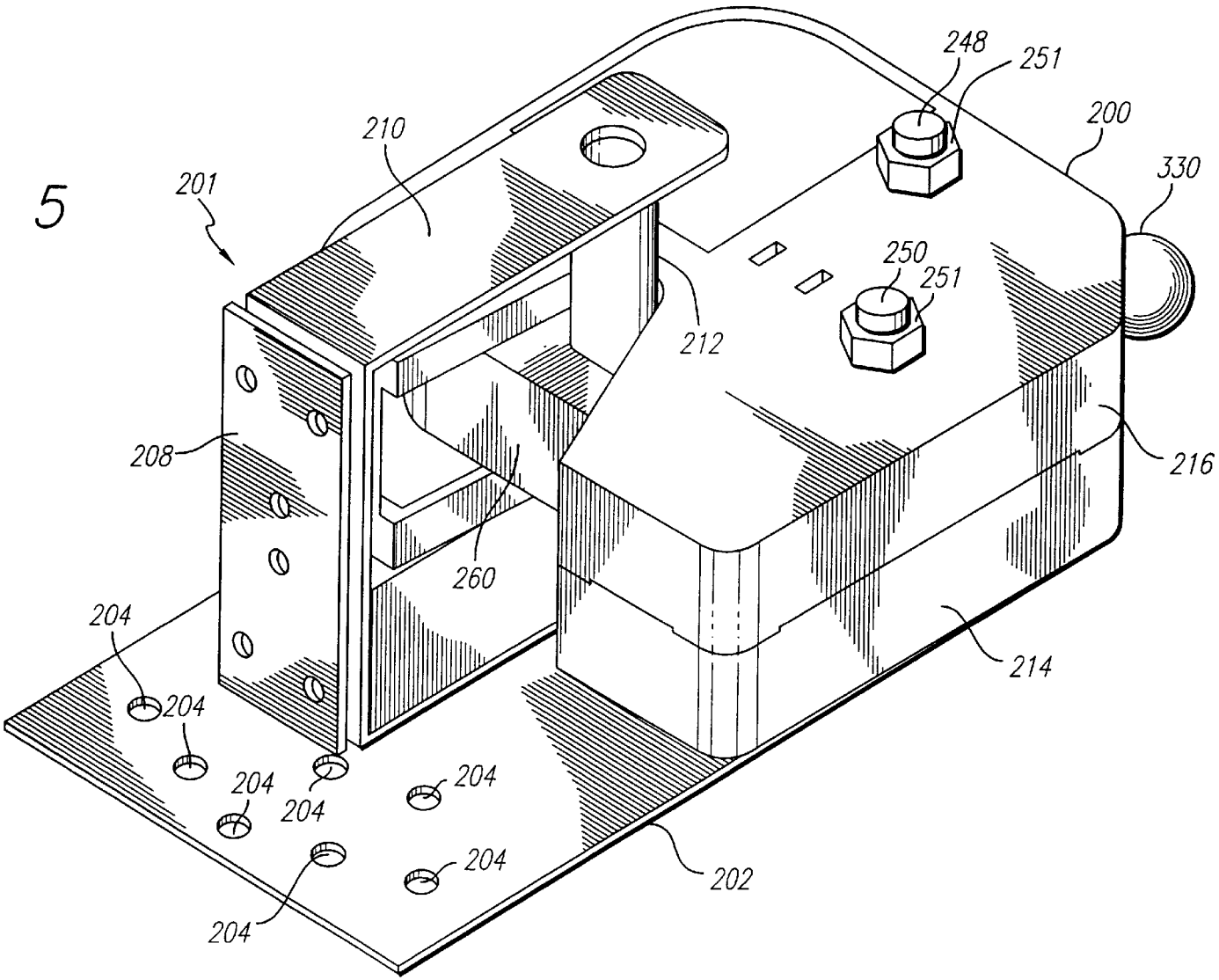
FIG. 5 is a perspective view of an alternative embodiment of the security device in its secured position with the garage door closed.
Figure 6:
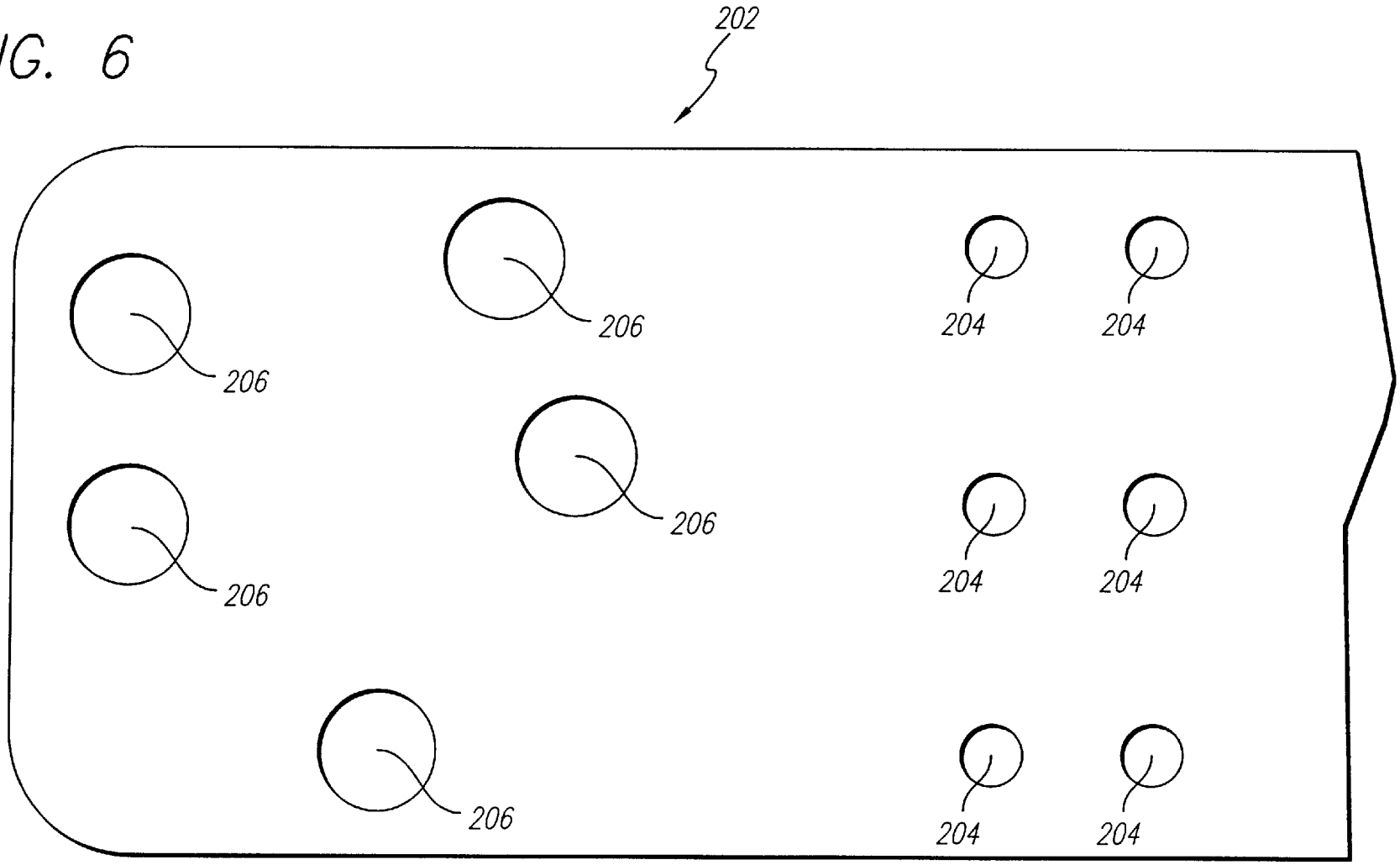
FIG. 6 is a close-up top view of a mounting bracket for the security device of the embodiment of the present invention shown in FIG. 5.

Referring now to FIGS. 2–4, the mechanism of the locking assembly 51 is shown. This mechanism includes a first rotating element or primary locking gear 57, a second rotating element or secondary gear 80, and a rotating latching element or latch hook 94. A base 54 is mounted on the support frame 15 by screws (not shown). Other types of fasteners can also be used such as bolts, nails, or clips. A first, second, and third shaft 58, 82, 96, respectively, are either attached to the base 54 or are fabricated integrally with the base 54. In order to protect the interior mechanism of the locking assembly 51 from the environment and to prevent exposure to the elements and prevent the potential for bodily injuries, the locking assembly 51 can be fully enclosed. One end of a side housing 55 is either attached or integrally formed with the base 54, and the other end of the side housing 55 is capped with a lid 56.

The primary locking gear 57 is rotatably mounted to the first shaft 58 (see FIGS. 2, 3, and 4). The primary locking gear 57 has rectangular teeth 59 and a detent, which is shown in the drawings as a fork 60, wherein the fork 60 has an U-shaped slot 62 which engages (see FIG. 2) and disengages (see FIG. 3) with the rod 52. The slot 62 can also have a rectangular or triangular shape, or any other shape which will engage and disengage with the rod 52. The primary locking gear 57 rotates about a first set of spacers 64, 66 adjacent to the top (68) and bottom tabs (not shown), respectively, of the primary locking gear 57.

In addition, the primary locking gear 57 is urged to rotate in a counterclockwise direction to its disengagement position with the rod 52 by a first torsion spring 72 (see FIG. 4). A first end 73 of the torsion spring 72 bears against a first pin 74 that extends out from the hub 68 of the primary locking gear 57, and the second end 75 of the torsion spring 72 bears against a second pin 76 that extends out from the base 54 and projects through the primary locking gear 57 via an arcuate slot 78 formed in the primary locking gear 57. The invention is not limited to torsion springs as shown in the drawings, but may be carried out with any other type of spring or mechanism which forces the primary locking gear 57 to rotate in one direction.

The secondary gear 80 is comprised of a region with substantially rectangular teeth 83 and another region with ramped teeth 84 (see FIGS. 2–4). The secondary gear 80 is mounted to the second shaft 82 in a manner where the rectangular teeth 83 of the secondary gear 80 are rotatively coupled with the rectangular teeth 59 of the primary locking gear 57. The secondary gear 80 rotates about a second set of spacers 86, 88 mounted on the top 90 and bottom hubs (not shown), respectively, of the secondary gear 80.

The latch hook 94, which is rotatably mounted to the third shaft 96, preferably has a locking surface 98 and a cam surface 100 (see FIGS. 2–4). The latch hook 94 engages (see FIG. 3) and disengages (see FIG. 2) with the secondary gear 80 at the locking surface 98. When the locking surface 98 is engaged with the secondary gear 80, the secondary gear 80 is restricted from rotating in the clockwise direction, but it is free to rotate in the counterclockwise direction because the cam surface 100 is able to ride along the ramped teeth 84. Correspondingly, the primary locking gear 57 is restricted from rotating in the counterclockwise direction, but it is free to rotate in a clockwise direction until it is stopped by either the rod 52 abutting against a vertex 102 of a V-shaped slot 104 formed in the base 54, or the cam surface 100 abutting against the substantially rectangular teeth 83. When the locking surface 98 is disengaged from the secondary gear 80, the secondary gear 80 is free to rotate in both the clockwise and counterclockwise directions, and correspondingly, the primary locking gear 57 can freely rotate in both directions.

The latch hook 94 is urged to rotate in a clockwise direction to its engagement position with the secondary gear 80 (see FIG. 3) by a second torsion spring 106 having a first end 108 bearing against an arcuate post 110 extending out from the base 54, and the second end 112 of the torsion spring 106 bears against a L-shaped tab 114 extending out from the latch hook 94 (see FIGS. 2, 3, and 4). Again, the invention is not limited to torsion springs, but can be carried out with any other type of spring or mechanism for forcing the latch hook to rotate in a clockwise direction.

The primary locking gear 57, secondary gear 80, and latch hook 94 are formed from a high strength metal such as steel. However, other materials having adequate strength and reliability such as polymers, plastics, or injection molded nylon, as is well-known to those of ordinary skill in the art, may be used if cost is a critical factor.

An actuator, which is mounted on the base 54 and side housing 55, causes the latch hook 94 to disengage from the secondary gear 80. In one embodiment of the present invention, the actuator is a solenoid 116 having a locking pin 118. The locking pin 118 is extended (see FIG. 3) when the solenoid 116 is de-energized and retracted (see FIG. 2) when the solenoid 116 is energized. The actuator may be any electronic solenoid or other device known in the art for selectively moving a pin or other element to and from an extended to a retracted position, such as pneumatic and hydraulic cylinders.

The solenoid 116 is coupled to the latch hook 94 by a braided wired 120. The first end 122 of the braided wire 120 is connected to the locking pin 118, and the second end 124 of the braided wire 120 is connected to a U-shaped tab 126 formed on the latch hook 94. Usually, the solenoid 116 is de-energized, the locking pin 118 is extended, and the latch hook 94 is engaged with the secondary gear 80. The latch hook 94 is in the engaged position because the tension on the braided wire 120 pulling on the latch hook 94 is less than the clockwise rotational force placed on the latch hook 94 by the torsion spring 106. When the solenoid 116 is energized, the locking pin 118 is retracted, the braided wire 120 pulls the latch hook 94, and the latch hook 94 rotates in the counterclockwise direction and disengages with the secondary gear 80.

First, second, third, and fourth pulleys 128, 130, 132, 134 are mounted on the base 54. These pulleys 128, 130, 132, 134 guide the braided wire 120 from the locking pin 118 to the U-shaped tab 126. The solenoid 116 and latch hook 94 can be positioned in a manner which requires fewer or more pulleys, or, in certain configurations, no pulleys.

A manual release member 140 is coupled to the braided wire 120 between the third pulley 132 and the fourth pulley 134 (see FIGS. 2–4). The manual release member 140 comprises a spherical knob 142, which an operator can easily grasp, a body 144, and an opening 146. The braided wire 120 extends through the opening 146. An operator can manually unsecure the locking assembly 51 by simply pulling the spherical knob 142, thereby pulling the braided wire 120 in the same manner described above when the solenoid 116 is energized to cause the latch hook 94 to disengage from the secondary gear 80.

Figure 17:
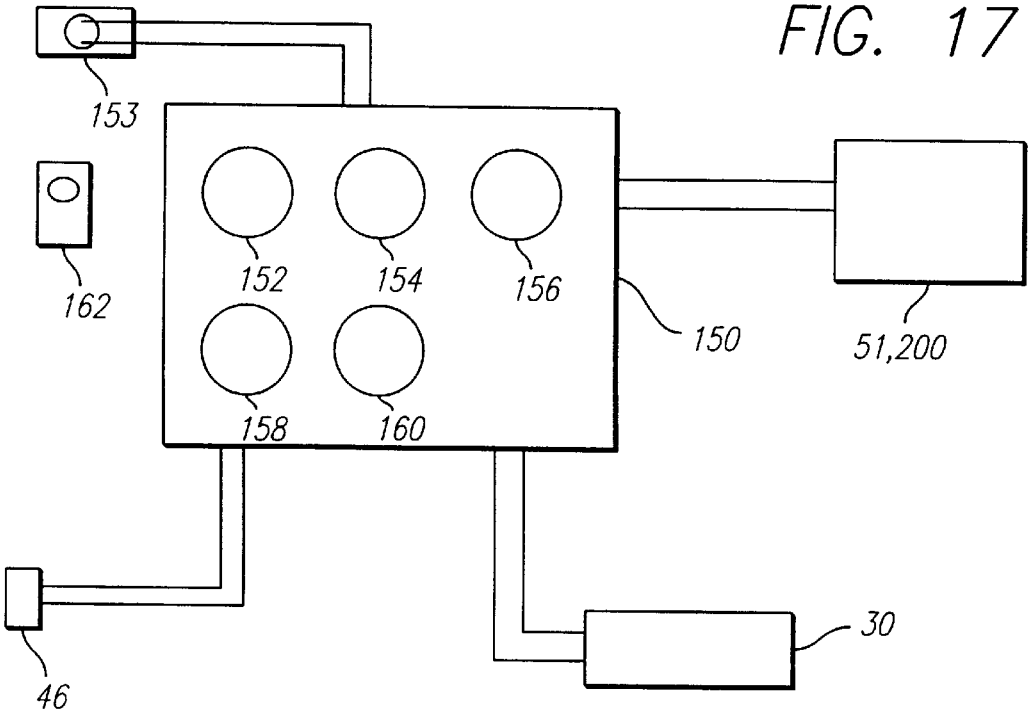
FIG. 17 is a block diagram of the electronics which controls the security device illustrated in FIG. 5 for a garage door equipped with a garage door opener.

FIG. 17 is a block diagram of a preferred embodiment of the electronics which control the security device 50 for a garage door 10 equipped with a garage door opener 30. The electronics module 150 includes an AC to DC power transformer 152, a radio frequency receiver 154, a timer element 156, solenoid relay 158, and electric motor relay 160 for the garage door opener 30. The electronics module 150 is coupled to the garage door opener 30, garage door opener button 46, locking assembly 51, 200, and radio frequency transmitter 162.

The AC to DC power transformer 152 is connected to a power supply such as standard electrical outlet 153. If the electronics module 150 is positioned near the housing 38 of the garage door opener 30, the electronics module 150 can be plugged into the same electrical outlet as the garage door opener 30. If an electrical outlet is not available, an adapter can be screwed into the light bulb socket of the garage door opener 30, and the electronics module 150 can be plugged into the adapter. Alternative power sources such as a battery may also be used.

The solenoid relay 158 and the electric motor relay 160 are activated when the radio frequency transmitter 162 sends a signal to the radio frequency receiver 154 or when the garage door opener button 46 sends a signal to the electronics module 150. The radio frequency transmitter 162 may incorporate anti-code scanning and transmitter programmable features. When the solenoid relay 158 and electric motor relay 160 are activated, the solenoid 116, 312 and electric motor 44 are energized. The timer element 156 is coupled to the solenoid relay 158 and allows the solenoid relay 158 to remain activated for a specified time interval, and therefore, allows the garage door opener 30 or an operator to open the garage door 10 before the solenoid 116, 312 is de-energized. Generally, the specified time interval can be approximately 5–10 seconds.

The present invention shown in FIGS. 2–4 and 17 operates in the following manner when the garage door 10 is equipped with a garage door opener 30. Presuming the garage door 10 is closed and secured, the rod 52 is engaged in the U-shaped slot 62 of the primary locking gear 57, the primary locking gear 57 is rotated to its full clockwise position, the secondary gear 80 is rotated to its full counterclockwise position, and the latch hook 94 is engaged with the secondary gear 80. The solenoid 116 is de-energized and the locking pin 118 is extended.

The garage door 10 can be opened and unsecured by an operator activating the solenoid 116 by engaging the garage door opener button 46 or radio frequency transmitter 162 (see FIGS. 1–4 and 17). The electronics module 150 energizes the solenoid 116, and the locking pin 118 of the solenoid 116 is retracted for the specified time interval. The locking pin 118 pulls the braided wire 120, and the braided wire 120 pulls the latch hook 94 away from its engagement with the secondary gear 80. The electric motor 44 for the garage door opener 30 is energized simultaneously with the solenoid 116, and the garage door 10 is carried towards a horizontal open position. As the garage door 10 is opening, the rod 52 forces the primary locking gear 57 to rotate to its full counter-clockwise position and the secondary gear 80 to rotate to its full clockwise position. As the primary locking gear 57 rotates in the counterclockwise direction, the rod 52 is released.

The electric motor 44 for the garage door opener 30 automatically stops when the garage door 10 is carried to the horizontal open position. The first torsion spring 72 forces the primary locking gear 57 to remain in the full counterclockwise position and the secondary gear 80 to remain on the full clockwise position, wherein the primary locking gear 57 is positioned to accept the rod 52.

The garage door 10 can be closed and secured by engaging the garage door opener button 46 or the radio frequency transmitter 162 (see FIGS. 1–4 and 17). The electronics module 150 energizes the electric motor 44, and the electric motor 44 lowers the garage door 10 downwardly to a vertical closed position where the electric motor 44 automatically stops. The rod 52 is engaged in the U-shaped slot 62 of the primary locking gear 57, the primary locking gear 57 is rotated against the force of the first torsion spring 72 to its full clockwise position, the secondary gear 80 is rotated to its full counterclockwise position, and the latch hook 94 is engaged with the secondary gear 80. At this point, the garage door 10 is once again closed and secured.

Figure 18:
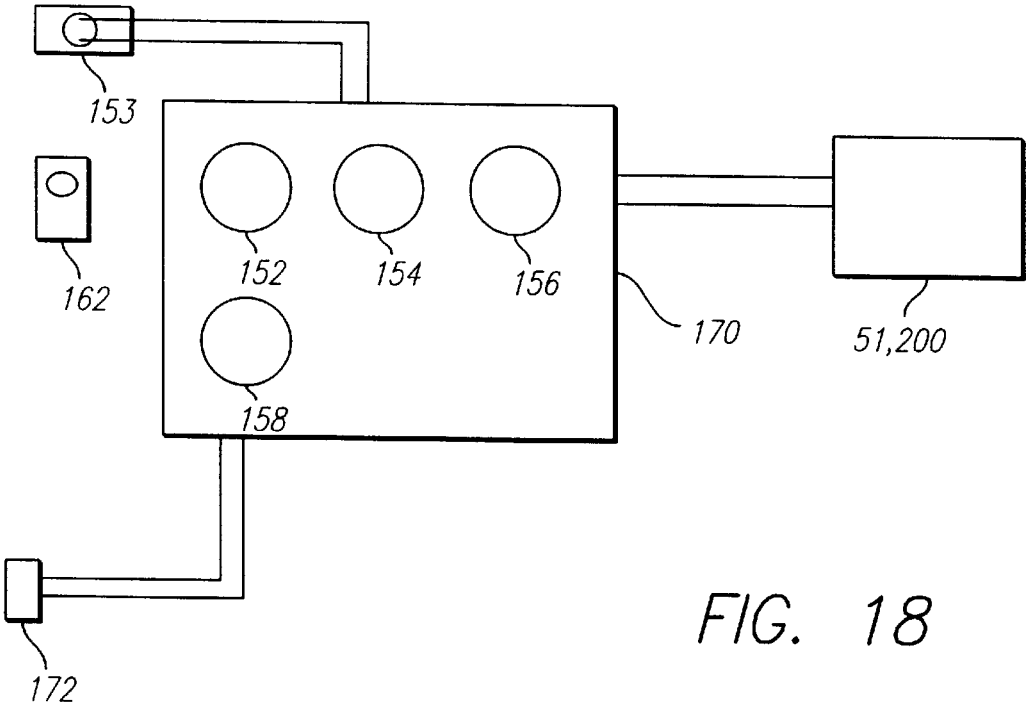
FIG. 18 is a block diagram of the electronics which controls the security device illustrated in FIG. 5 for a garage door not equipped with a garage door opener.

FIG. 18 is a block diagram of an embodiment of the electronics which control the security device 50 for a garage door 10 not equipped with a garage door opener. The electronics module 150 includes an AC to DC power transformer 152, a radio frequency receiver 154, a timer element 156, and a solenoid relay 158. The electronics module 150 is coupled to an interior solenoid switch 172, locking assembly 51, 200, and radio frequency transmitter 162.

In this embodiment, the AC to DC power transformer 152 is plugged into a power source such as a standard electrical outlet 153, but it can also be hard wired if desired. Alternative power sources such as a battery may also be used.

The solenoid relay 158 is activated when the radio frequency transmitter 162 sends a signal to the radio frequency receiver 154 or when the interior solenoid switch 172 sends a signal to the electronics module 150. When the solenoid relay 158 is activated, the solenoid 116, 312 is energized. The timer element 156 is coupled to the solenoid relay 158 and allows the solenoid relay 158 to remain activated for a specified time interval, and therefore, allows the operator to open the garage door 10 before the solenoid 116, 312 is deactivated. Generally, the specified time interval can be approximately 5–10 seconds.

The present invention shown in FIGS. 2–4 and 18 operates in the following manner when the garage door 10 is not equipped with a garage door opener. Presuming the garage door 10 is closed and secured, the locking assembly 51 and rod 52 are in the same state as discussed above for present invention operating in conjunction with a garage door opener.

The garage door 10 can be manually opened and unsecured by engaging the interior solenoid switch 172 or radio frequency transmitter 162 (see FIG. 18). The solenoid relay 158 is activated and energizes the solenoid 116. The solenoid 116 retracts its locking pin 118 for the specified time interval. The locking pin 118 pulls the braided wire 120, and the braided wire 120 pulls the latch hook 94 away from its engagement with the secondary gear 80. As the operator manually opens the garage door 10, the rod 52 forces the primary locking gear 57 to rotate to its full counterclockwise position and the secondary gear 80 to its full clockwise position. As the primary locking gear 57 rotates in the counterclockwise direction, the rod 52 is released. The first torsion spring 72 forces the primary locking gear 57 to remain in the full counterclockwise position and the secondary gear 80 to remain in the full clockwise position. When the specified time interval ends, the solenoid 116 is de-energized, the locking pin 118 is extended, the latch hook 94 rotates in a clockwise direction and engages the secondary gear 80. The secondary gear 80 and the primary locking gear 57 is positioned to accept the rod 52.

The garage door 10 can be closed and secured by manually closing the garage door 10. When the operator closes the garage door, the rod 52 begins to engage the U-shaped slot 62 of the primary locking gear 57, thereby causing the primary locking gear 57 to rotate against the force of the torsion spring 72 to its full clockwise position (see FIGS. 2–4). As the primary locking gear 57 rotates, the secondary gear 80 rotates to its full counterclockwise position, and the latch hook 94 is engaged with the secondary gear 80. At this point, the garage door 10 is once again closed and secured.

Referring now to FIGS. 5–16, a second embodiment of the security device 50 is shown. The security device 50 comprises a mounting bracket 202, locking assembly 200, and securing element 201. The mounting bracket 202, which has screw holes 204 and bolt holes 206, can be mounted onto the support frame 15 with screws (not shown) through the screw holes (see FIG. 6). The locking assembly is attached to the mounting bracket 202 by a first 246, second 248, and third bolt 250 and by nuts 251.

The corresponding securing element 201 comprises a base 208, a U-shaped bracket 210, and a rod 212. The securing element 201 is mounted onto the side edge of the garage door 10 by screws (not shown), and the locking assembly 200 engages and disengages with the rod 212.

Figure 7:
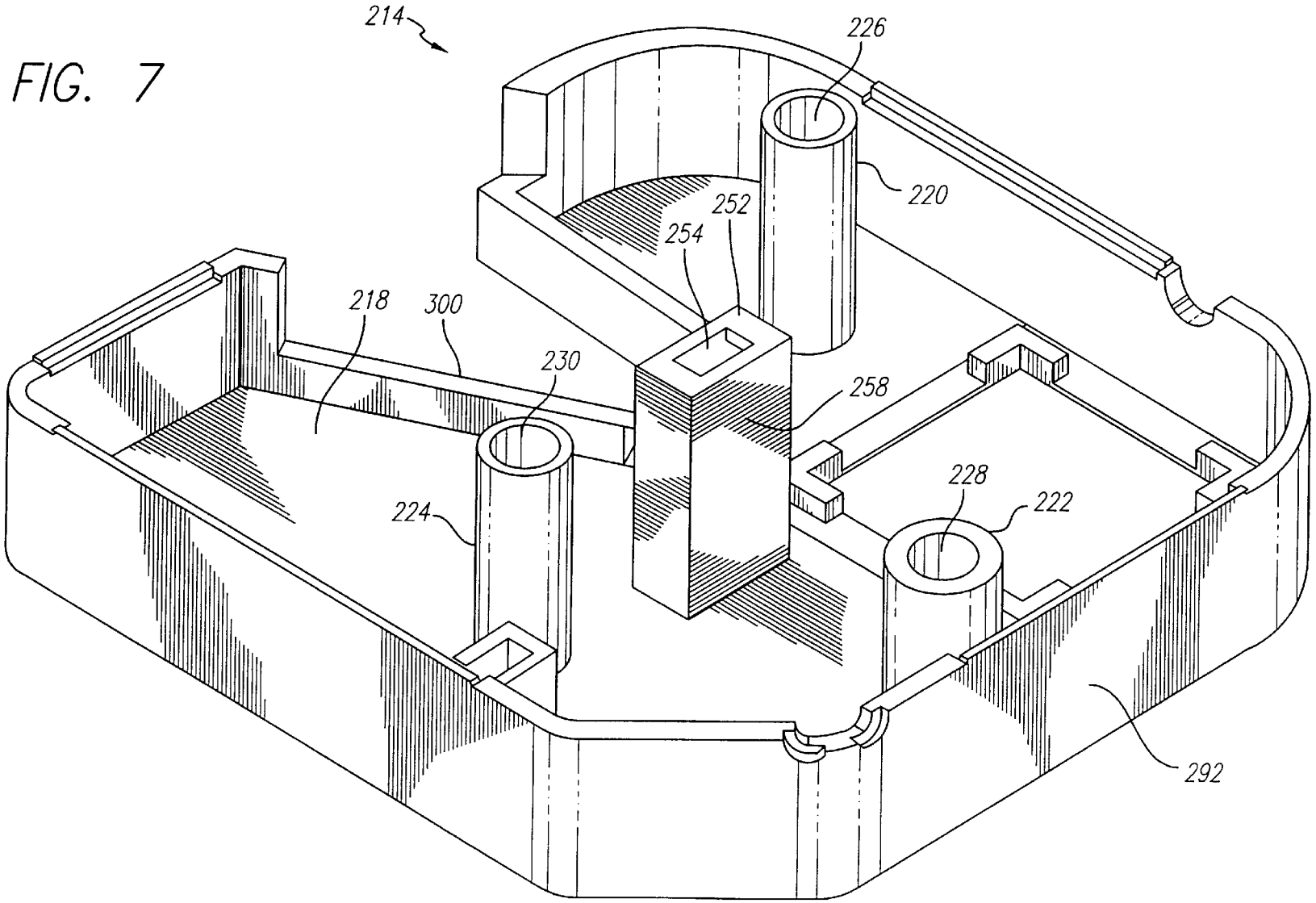
FIG. 7 is a perspective view of the bottom case shown in FIG. 5.
Figure 8:
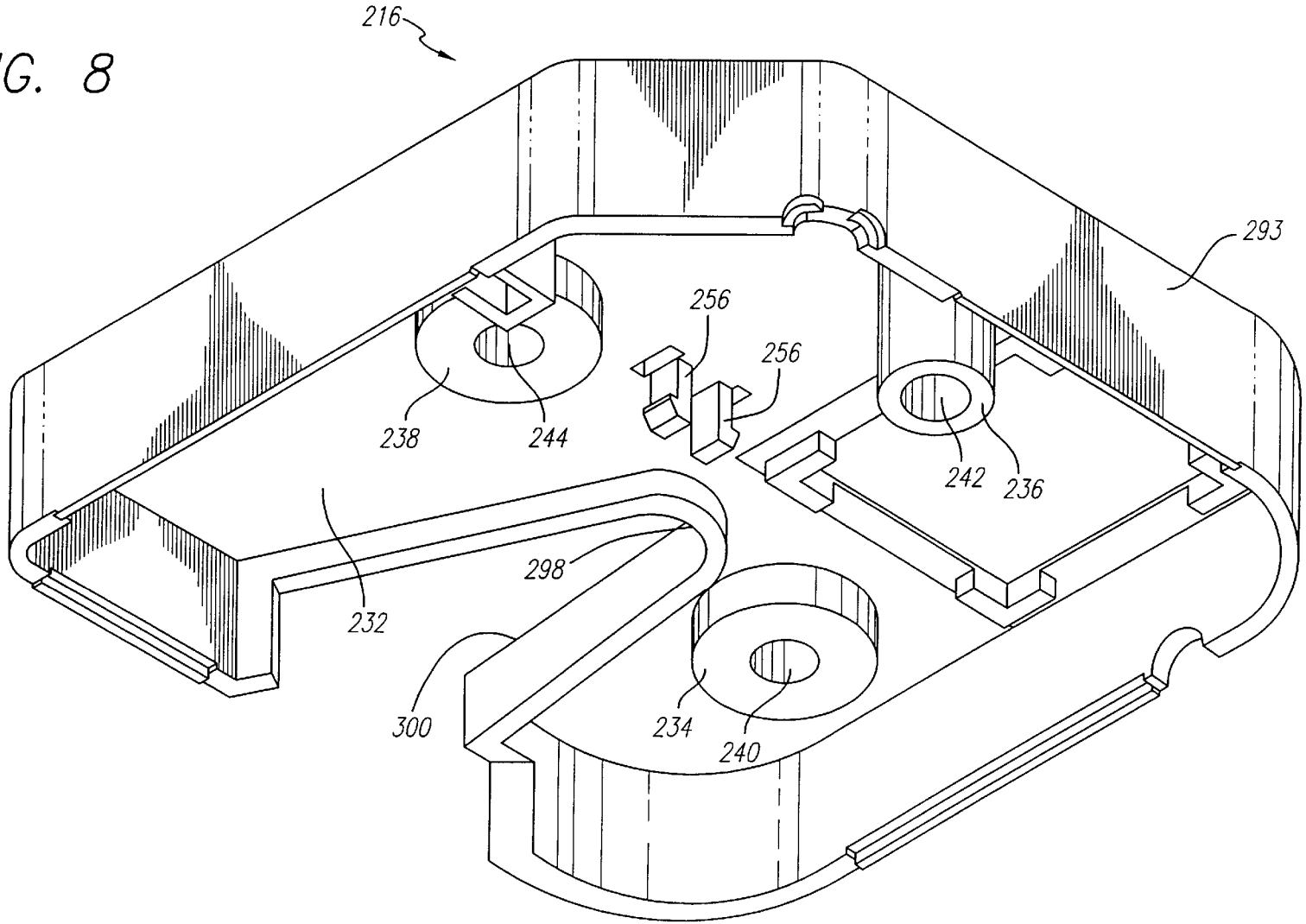
FIG. 8 is a perspective view of the top case shown in FIG. 5.

The mechanism of the locking assembly 200 is housed in a bottom 214 and top case 216 (see FIGS. 7 and 8). The bottom case 214 has a base 218 which includes a first 220, second 222, and third shaft 224. Each of these shafts 220, 222, 224 includes a first 226, second 228, and third hole 230, respectively. The top case 216 has a base 232 which includes a first 234, second 236, and third spacers 238. Each of these spacers 234, 236, 238 includes a first 240, second 242, and third hole 244, respectively. The mounting bracket 202, bottom case 214, and top case 216 are secured together by the first 246, second 248, and third bolt 250 positioned in the holes 206, 226, 228, 230, 240, 242, 246 of the mounting bracket 202, bottom case 214, and top case 216 and secured by the nuts 251. The bottom 214 and top case 216 are also fastened together by a locking latch arrangement. The base 218 of the bottom case 214 has a securing plate 252 with at least one opening 254. The opening 254 is provided to accept locking latches 256 formed on the base 218 of the top case 216. The securing plate 252 preferably has sidewalls 258 to give it depth so that it can accept the locking latches 256.

The locking assembly 200 includes a locking element or lock 260, a latching element or lock arm 262, and a pivoting element or pivot tab 264 (see FIGS. 9–16). The lock 260 is rotatably mounted to the first shaft 220. The lock 260 has a detent which is shown in the drawings as a fork 266, wherein the fork 266 has a U-shaped slot 268 which engages (see FIG. 9) and disengages (see FIG. 11) with the rod 212. The U-shaped slot 268 can have a rectangular triangular, or any other shape which will engage and disengage with the rod 212 other corresponding securing element. A first 272 and second prong 274, which form the U-shaped slot 268, have a first 276 and second cam surface 278, respectively. In addition, the first 272 and second prong 274 preferably have a first 280 and second contact surface 282, respectively, which are generally flat and located opposite their respective cam surfaces 276, 278. The lock 260 rotates about the first shaft 220 and on the first bearing surface 236 of the top case 216.

Figure 13:
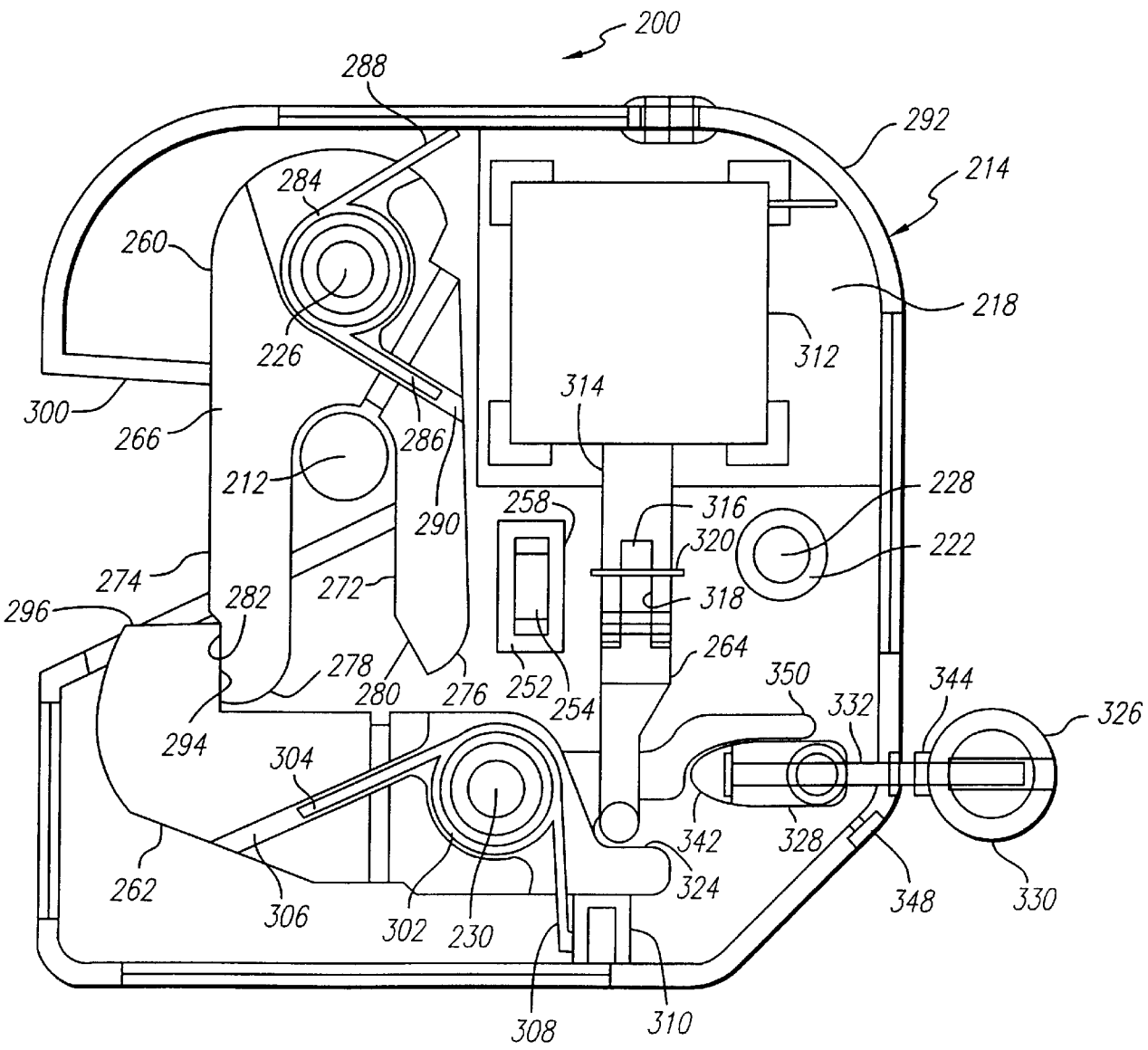
FIG. 13 is a close-up top view of the security device of the embodiment of the present invention shown in FIG. 5 in its secured position being manually unsecured with the manual release handle extended in its secured position.
Figure 14:
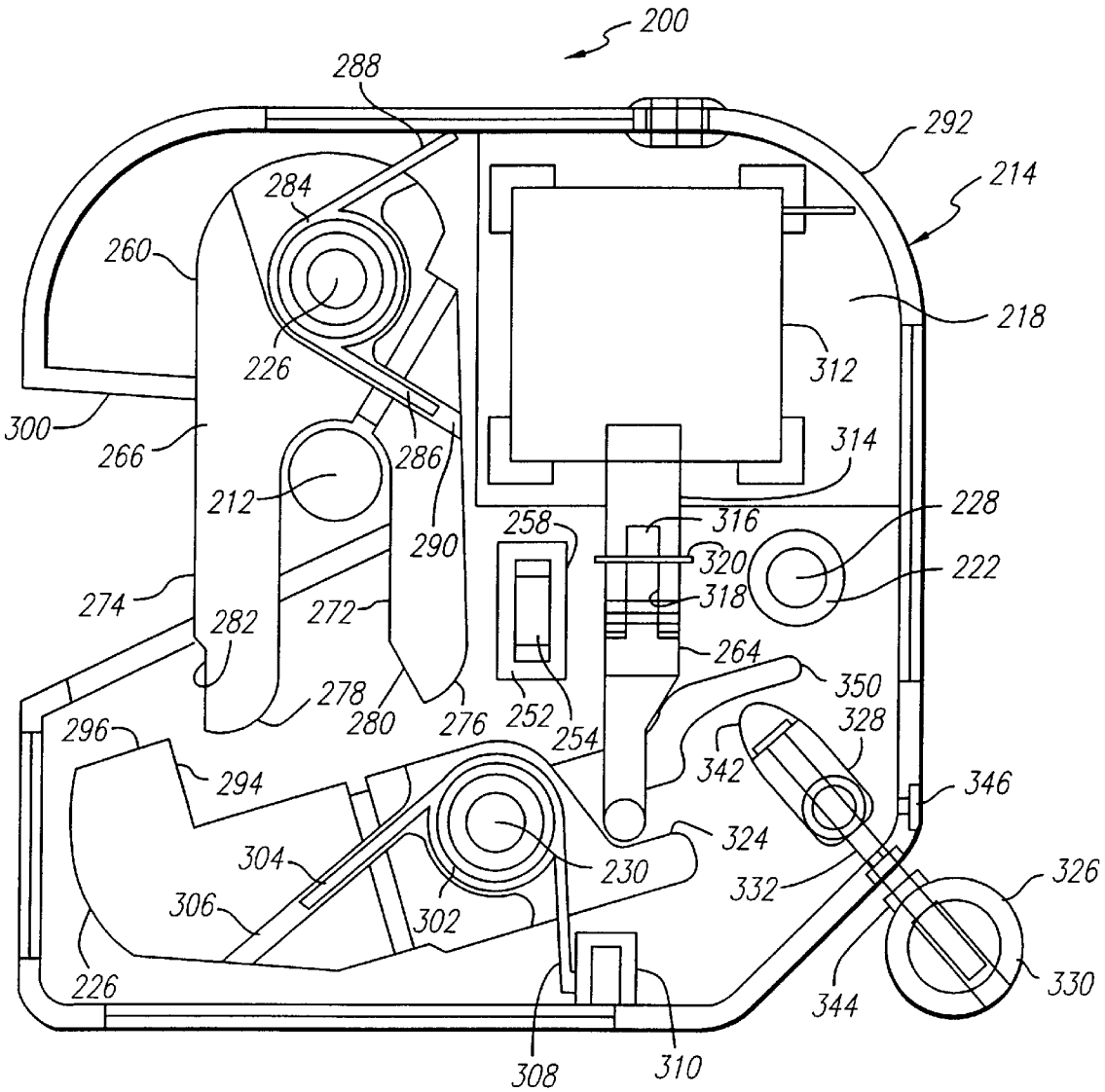
FIG. 14 is a close-up top view of the security device of the embodiment of the present invention shown in FIG. 5 in its unsecured position with the override handle extended in its unsecured position.
Figure 15:
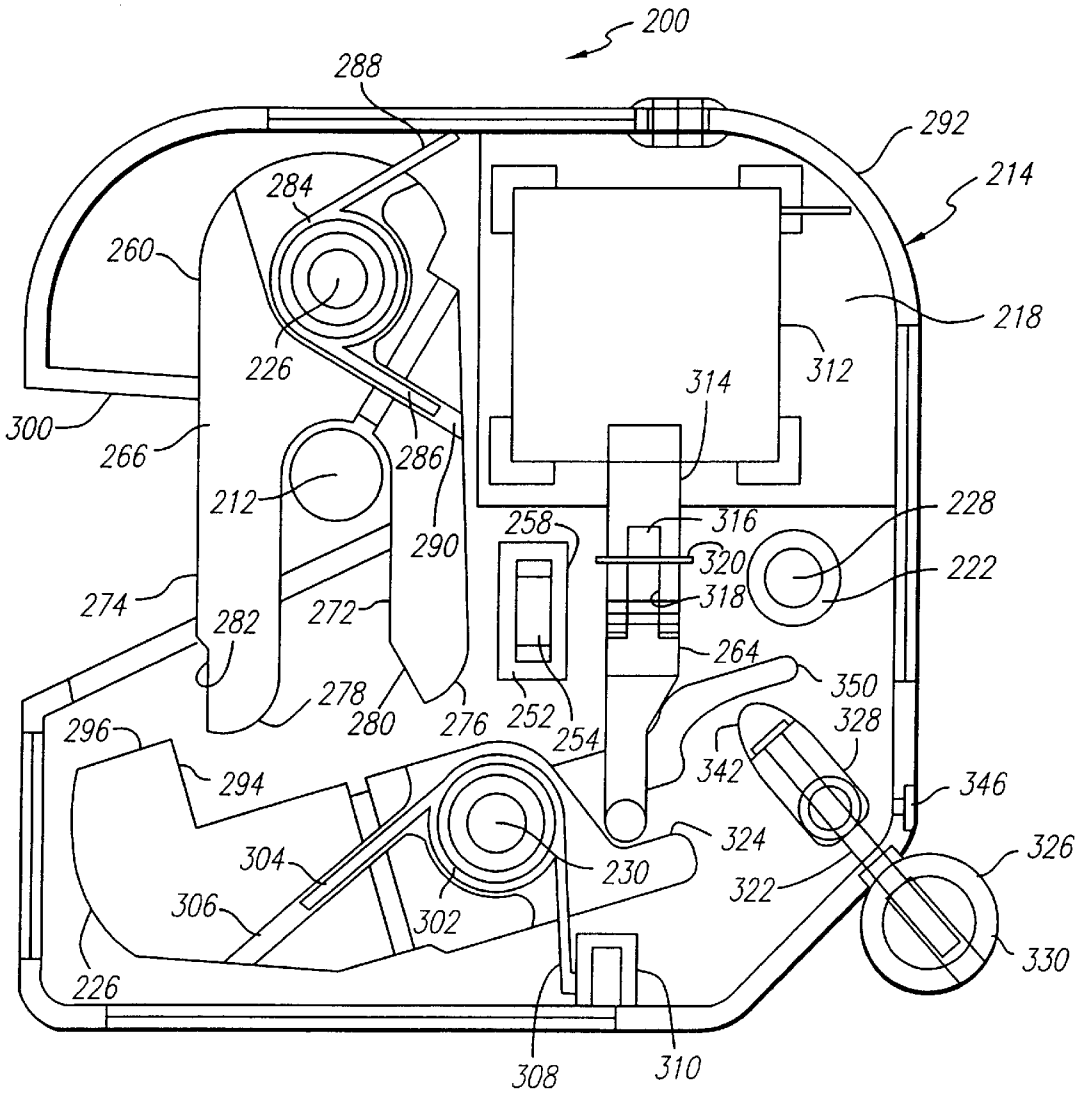
FIG. 15 is a close-up top view of the security device of the embodiment of the present invention shown in FIG. 5 in its unsecured position with the override handle locked in its unsecured position.
Figure 16:
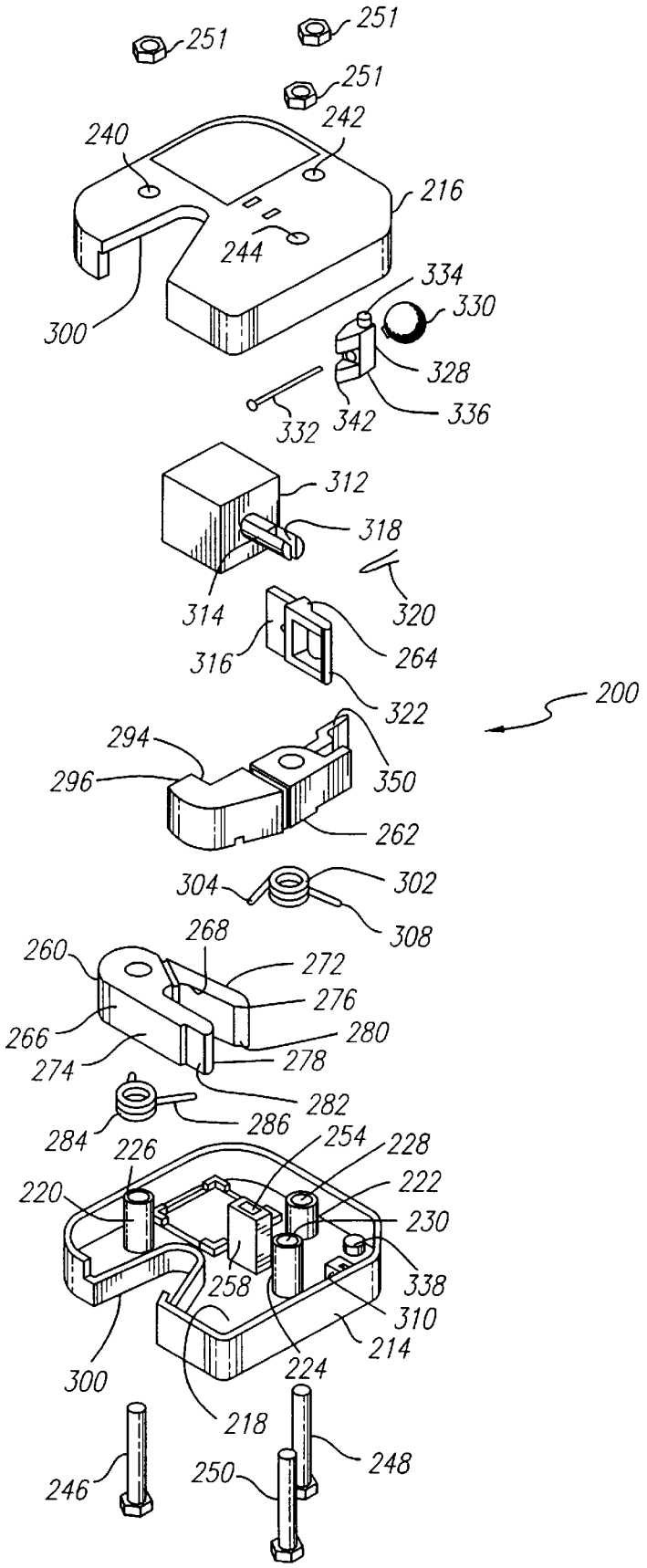
FIG. 16 is an exploded view of the security device of the embodiment of the present invention shown in FIG. 5.

In addition, the lock 260 is urged to rotate in a clockwise direction to its engagement position with the rod 212 by a first torsion spring 284 (see FIG. 13). A first end 286 of the torsion spring 284 is fixedly mounted into a groove 290 formed on the surface of the lock 260, and a second end 288 of the torsion spring 284 bears against a wall 292 of the bottom case 214. The invention is not limited to the torsion spring 260 as shown in the drawings but may be carried out with any other type of mechanism which forces the lock to rotate in one direction.

Figure 9:
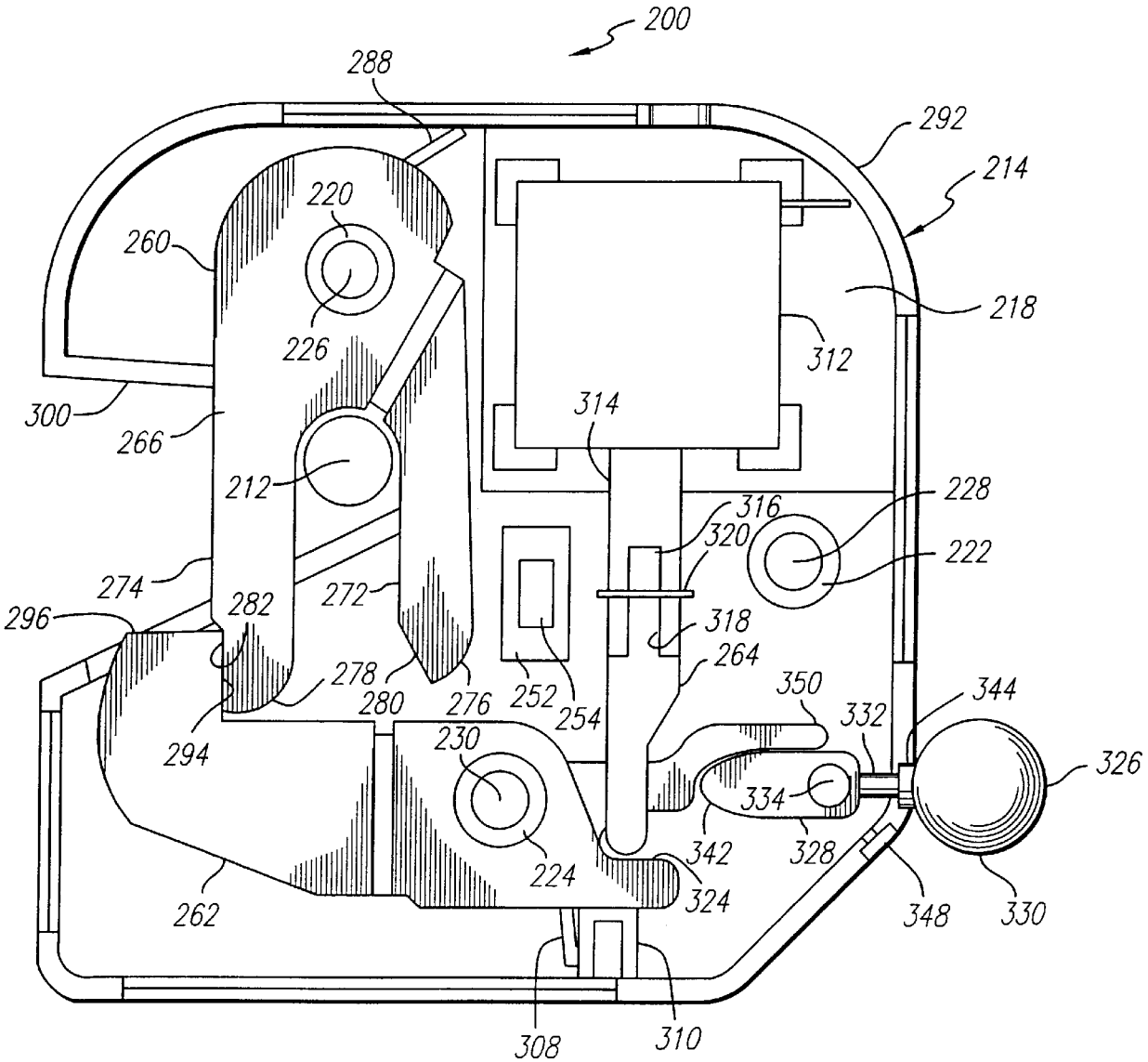
FIG. 9 is a close-up top view of the security device of the embodiment of the present invention shown in FIG. 5 in its secured position with the garage door closed.
Figure 10:
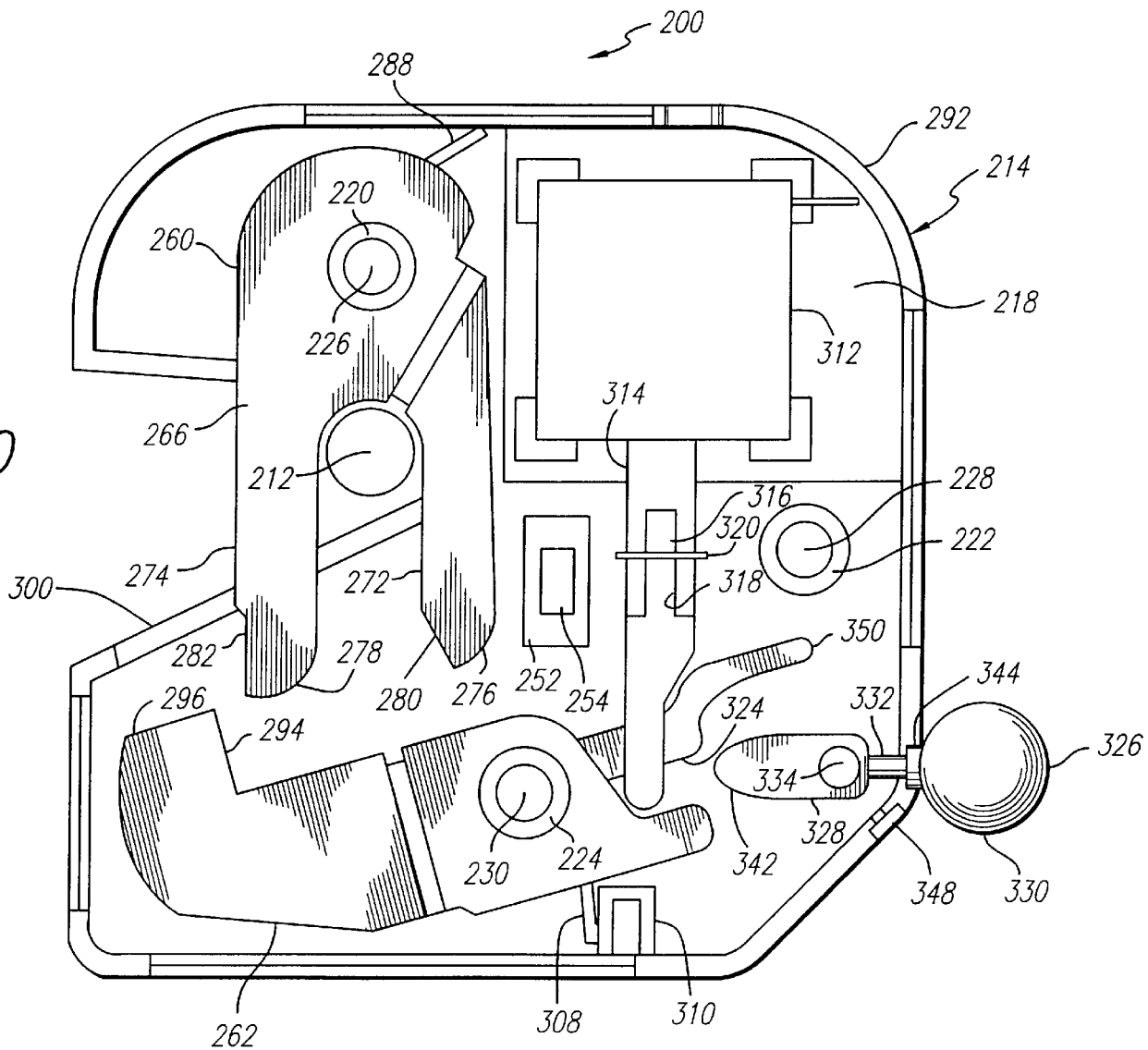
FIG. 10 is a close-up top view of the security device of the embodiment of the present invention shown in FIG. 5 in its unsecured position with the garage door closed and about to be opened.
Figure 11:
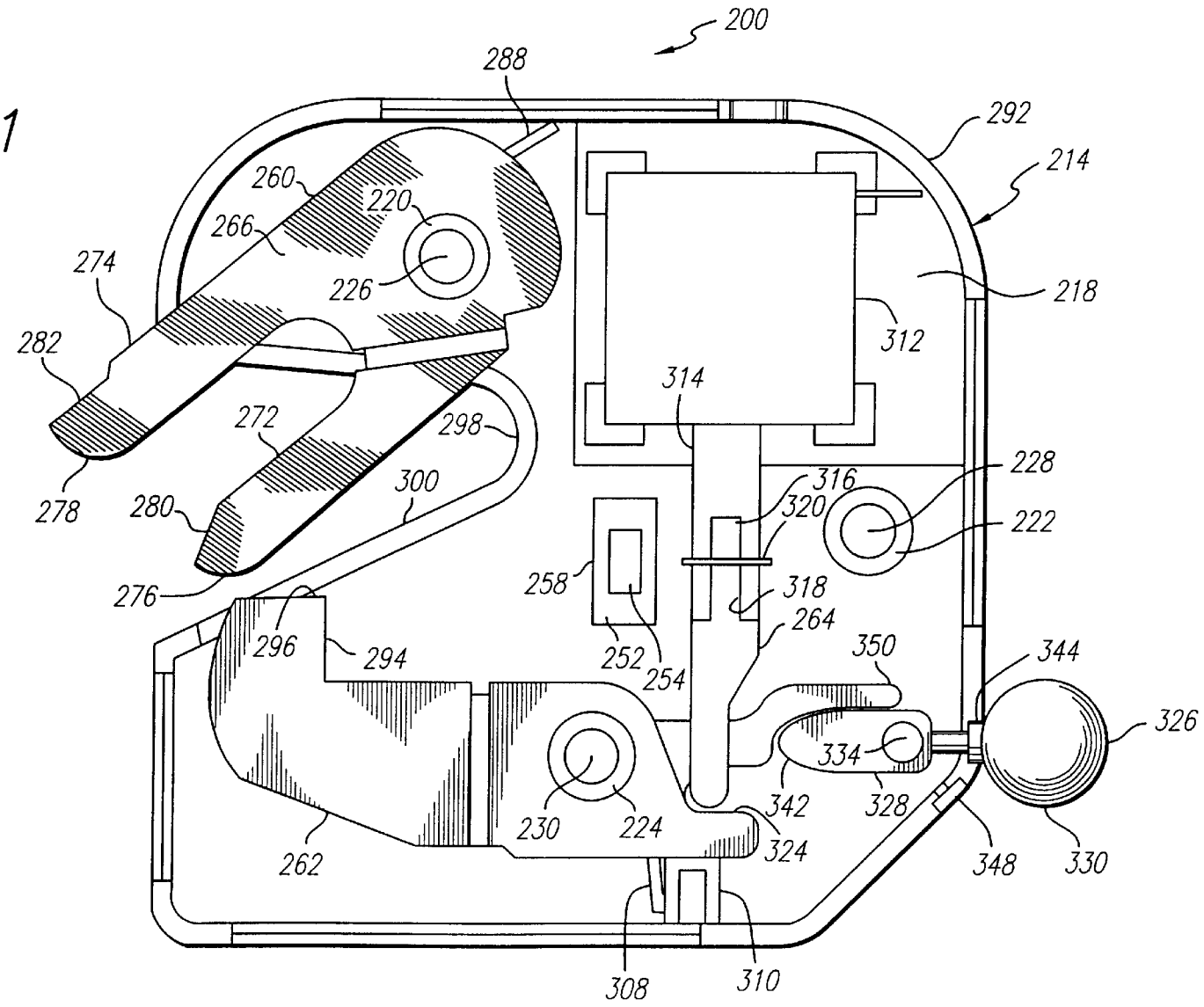
FIG. 11 is a close-up top view of the security device of the embodiment of the present invention shown in FIG. 5 in its secured position with the garage door being opened.
Figure 12:
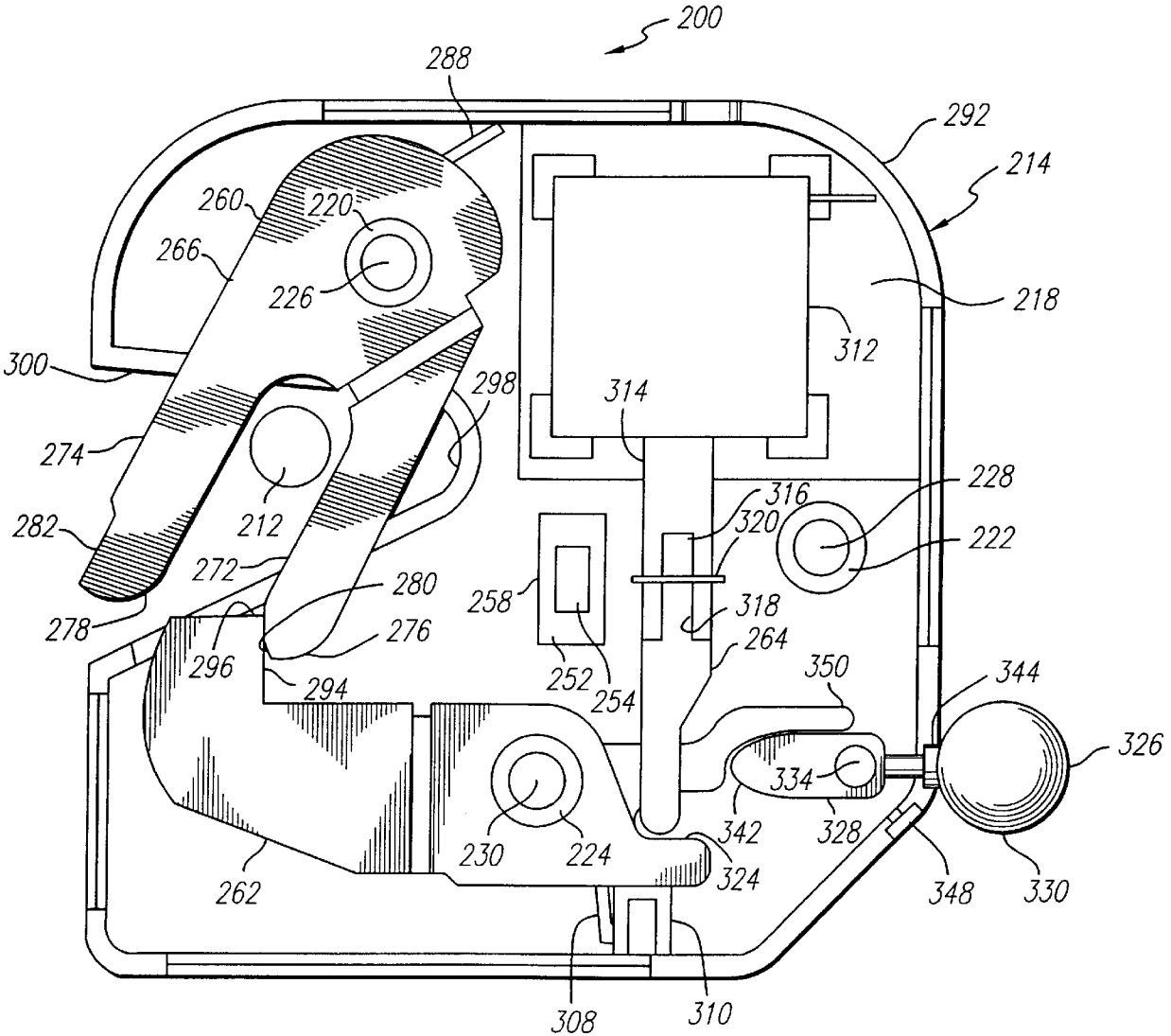
FIG. 12 is a close-up top view of the security device of the embodiment of the present invention shown in FIG. 5 in its secondary secured position with the garage door closed.

The lock arm 262 is rotatably mounted to the third shaft 224 and preferably has a locking surface 294 and a cam surface 296 (see FIGS. 9–16). The locking surface 294 of the lock arm 262 engages (see FIGS. 9 and 12) and disengages (see FIG. 10) with either the first 280 or second contact surface 282 of the lock 260. When the locking surface 294 is engaged with the lock 260 (as shown in FIGS. 9 and 12) the lock 260 is restricted from rotating in the clockwise direction, but it is free to rotate in a counterclockwise direction until it stopped by the rod 212 abutting against a vertex 298 of a V-shaped slot 300 formed in the base 218, 232 of the bottom 214 and top case 216.

The lock arm 262 is urged to rotate in a clockwise direction to its engagement position with the lock 260 (see FIG. 13) by a second torsion spring 302 having a first end 304 fixedly mounted into a groove 306 formed on the surface of the locking arm 262, and a second end 308 of the torsion spring 302 bears against a pedestal 310 located on the base 218 and wall 292 of the bottom case 214. The lock arm 262 is able to rotate in the clockwise direction until it is stopped by the lock arm 262 abutting against the pedestal 310 of the bottom case 214. Again, the invention is not limited to the torsion spring 302, but can be carried out with any other type of spring or mechanism for forcing the lock arm 262 to rotate in a clockwise direction.

An actuator, which is mounted on the base 218 of the bottom case 214, causes the lock arm 262 to engage and disengage with the lock 260 (see FIGS. 9–16). In one embodiment of the present invention, the actuator is a solenoid 312 having a locking pin 314. The locking pin 314 is extended (see FIGS. 9 and 11–12) when the solenoid 312 is de-energized and retracted (see FIG. 10) when the solenoid 312 is energized. The actuator may be any electronic solenoid, as shown in the drawings, or other device known in the art for selectively moving a locking pin 314 or other element to and from an extended to a retracted position.

The solenoid 312 is coupled to the lock arm 262 by the pivot tab 264 (see FIGS. 9–16). The pivot tab 264 has a rectangular shaped member 316 on one end which fits into a slit 318 of the locking pin 314 and is secured to the locking pin 314 by a cotter pin 320. The pivot tab 264 has a rod 322 at the other end, and the rod 322 is pivotally coupled to a U-shaped slot 324 located on the lock arm 262 at the end opposite the locking 294 and cam surfaces 296.

Usually, the solenoid 312 is de-energized, the locking pin 314 is extended, and the lock arm 262 is engaged with the second contact surface 282 of the lock 260 (see FIG. 9). When the solenoid 312 is energized, the locking pin 314 is retracted, the pivot tab 264 pulls the lock arm 262, and the lock arm 262 rotates in the counterclockwise direction and disengages with the lock 260.

A manual release member 326 includes a release tab 328, spherical knob 330, and bolt 332 (see FIGS. 5–11). The release tab 328 has a first 334 and second stud 336. The first 334 and second stud 336 fit into and rotate about a first 338 and second recess (not shown) formed in the bottom 214 and top case 216, respectively. The release tab 328 has a cam tip 342 on one end. The bolt 332 is positioned longitudinally through the release tab 328, and the spherical knob 330 is attached to the bolt 332 at the end opposite a cam tip 342. The spherical knob 330 has a flange 344 which fits into a first 346 or second recess 348 formed in the walls 292, 293 of the bottom 214 and top case 216. When the flange 344 is positioned in the first recess 346, the manual release member 326 is set at the secured position. The release tab 328 is positioned parallel to a flap 350 extending from the lock arm 262, and the lock arm 262 is engaged with the lock 260 (see FIG. 9). As the flange 344 is pulled out of the first recess 346 and positioned towards the second recess 348, the cam tip 342 slides along the flap 350 and causes the lock arm 262 to rotate in a counterclockwise direction (see FIGS. 13 and 14). When the flange 344 is positioned in the second recess 348, the manual release member 326 is set at the unsecured position. The cam tip 342 rotates the lock arm 262 to the full counterclockwise position such that the lock arm 262 is disengaged with the lock 260 (see FIG. 15).

The bottom case 214, top case 216, lock 260, lock arm 262, pivot tab 264, and release tab 328 are formed from an injection molded nylon. However, other plastics and metals having adequate strength and reliability may be used. The lock 260 and lock arm 262 may be further strengthened by having them formed in a multi-layer configuration.

The present invention shown in FIGS. 5–13 and 17 operates in the following manner when the garage door 10 is equipped with a garage door opener 30. Assuming the garage door 10 is closed and secured, the rod 212 is engaged in the U-shaped slot 268 of the lock 260, the lock 260 is rotated to its full clockwise position, and the lock arm 262 is rotated to its full counterclockwise position and is engaged with the lock 260. The solenoid 312 is de-energized and the locking pin 314 is extended.

The garage door 10 can be opened and unsecured by an operator energizing the solenoid 312 by engaging the garage door opener button 46 or the radio frequency transmitter 162 (see FIGS. 5–13 and 17). The electronics module 150 activates the solenoid relay 158, and the solenoid 312 is energized and retracts its locking pin 314 for the specified time interval. The locking pin 314 pulls the pivot tab 264, and the pivot tab 264 pulls the lock arm 262. The electric motor 44 for the garage door opener 30 is energized simultaneously with solenoid 312, and the garage door 10 is carried towards a horizontal open position. As the garage door 10 is opening, the rod 212 forces the lock 260 to rotate to its full clockwise position. As the lock 260 rotates in the clockwise direction the rod 212 is released.

The electric motor 44 for the garage door opener 30 automatically stops when the garage door 10 is carried to the horizontal open position. The first torsion spring 284 forces the lock 260 to remain in the full clockwise position. When the specified time interval ends, the solenoid 312 is de-energized. The second torsion spring 302 causes the lock arm 262 to rotate in the counterclockwise direction and towards its engagement position with the lock 260, and the locking pin 314 is extended. The lock 260 remains stationary, wherein the lock 260 is positioned to accept the rod 212.

The garage door 10 can be closed and secured by the operator activating the solenoid 312 by engaging the garage door opener button 46 or radio frequency transmitter 162 (see FIGS. 5–16 and 17). The electronics module 150 activates the electric motor relay 160, and the electric motor 44 is energized and lowers the garage door 10 downwardly to a vertical closed position where the electric motor 44 automatically stops. As the rod 212 engages with the U-shaped slot 268 of the lock 260, the lock 260 is rotated in a counterclockwise position against the force of the first torsion spring 284, and the cam surface 296 of the lock arm 262 slides along the first 276 and second cam surface 278 of the lock 260. The garage door 10 is once again closed and secured when the rod 212 is engaged in the U-shaped slot 268 of the lock 260, the lock 260 is rotated to its full counterclockwise position, and the lock arm 262 is rotated to its clockwise position, and the second contact surface 282 of the lock 260 is engaged with the locking surface 294 of the locking arm 262.

In the event that the garage door 10 is not fully closed, the garage door 10 may be adequately secured in a secondary secured position if the garage door 10 is lowered to an extent where the rod 212 engages with the U-shaped slot 268 of the lock 260, the lock 260 is rotated in a counterclockwise direction such that the first cam surface 276 of the lock 260 slides along the cam surface 296 of the lock arm 262, and the first contact surface 280 of the lock 260 engages with the locking surface 294 of the lock arm 262.

The present invention shown in FIGS. 5–13 and 18 operates in the following manner when it is not equipped with a garage door opener. Presuming the garage door 10 is closed and secured, the locking assembly 200 and rod 212 are in the same state as discussed above for this embodiment operating in conjunction with a garage door opener.

The garage door 10 can be manually opened and unsecured by an operator activating the solenoid 312 by engaging the interior solenoid switch 172 or the radio frequency transmitter 162 (see FIGS. 5–16 and 18). The electronics module 150 activates the solenoid relay 158, wherein the solenoid 312 is energized and retracts its locking pin 314 for a specified time period. The locking pin 314 pulls the pivot tab 264, and the pivot tab 264 pulls the lock arm 262 away from its engagement with the lock 260. As the operator manually opens the garage door 10, the rod 212 forces the lock 260 to rotate to its full clockwise position. As the lock 260 rotates in the clockwise direction, the rod 212 is released. The first torsion spring 284 forces the lock 260 to remain in the full clockwise position. When the specified time interval ends, the solenoid 312 is de-energized, the lock arm 262 rotates to its full clockwise position, and the locking pin 314 is extended. The lock 260 remains stationary, and is positioned to accept the rod 212.

The garage door 10 can be closed and secured by manually closing the garage door 10 (see FIGS. 5–13). When the operator closes the garage door 10, the rod 212 begins to engage the U-shaped slot 268 of the lock 260, thereby causing the lock 260 to rotate in a counterclockwise direction against the force of the first torsion spring 284, and the cam surface 296 of the lock arm 262 slides along the first 276 and second cam surface 278 of the lock 260. The garage door 10 is once again closed and secured when the rod 212 is engaged in the U-shaped slot 268 of the lock 260, the lock 260 is rotated to its full counterclockwise position, and the lock arm 262 is rotated to its clockwise position and engaged with the lock 260.

Although the present invention has been described in detail with regarding the exemplary embodiments and drawings thereof, it should be apparent to those skilled in the art that various adaptations and modifications of the present invention may be accomplished without departing from the spirit and scope of the invention. For instance, the primary locking gear 57, secondary gear 80, and latch hook 94 can all rotate about protrusions extending from the base 54 and lid 56 in such a manner that the protrusions from the base do not contact the protrusions from the lid 56. Instead of rotatively coupling the rectangular teeth 59 of the primary locking gear 57 with the rectangular teeth 83 of the secondary gear 80, the primary locking gear 57 can be rotatively coupled to the secondary gear 80 by a chain. Instead of coupling the solenoid 116 and latch hook 94 by a braided wire 120, the solenoid 116 can be coupled to the latch hook 94 by a linkage mechanism. Instead of using solenoids 116, 280 to rotate the latch hook 94 or lock arm 262, an electric motor can be used to rotate the latch hook 94 or the lock arm 262. Accordingly, the invention is not limited to the precise embodiment shown in the drawings and described in detail hereinabove.

What is claimed is:

1. A combination automatic garage door and security device for selectively securing and unsecuring a garage door to a support frame, the combination comprising:

a garage door;

a support frame supporting the garage door;

a locking assembly attached to one of said garage door and said frame, the locking assembly comprising:

a locking element having a detent;

a latching element, the latching element having a first end and a second end and being rotatable about an axis, the first end of the latching element being selectively engageable with the locking element, the latching element further comprising a manual release portion extending outwardly from the second end of the latching element; and an electronic solenoid having a pin, the pin being movable from a first position to a second position when the solenoid is activated, the length of the pin being greater when the pin is in its first position than when it is in its second position, the pin being coupled to the latching element;

a radio frequency receiver electrically coupled to the solenoid;

a securing element attached to the other one of said garage door and said frame;

a motor element, the motor element being coupled with the garage door and moving the door from its closed position to its opened position and from its opened position to its closed position when activated; and a manual release member, the manual release member comprising a knob, the knob having a first end that contacts the manual release portion of the latching element;

wherein when the garage door is secured, the detent of the locking element is securely coupled with the securing element.

2. The combination automatic garage door and security device of claim 1, further including an electronics module coupled to the locking assembly, wherein the electronics module includes a solenoid relay, an electric motor relay, and the radio frequency receiver.

3. The combination automatic garage door and security device of claim 2, wherein the solenoid relay and the electric motor relay are adapted to be activated when a radio frequency transmitter sends a signal to the radio frequency receiver, the solenoid relay energizing the solenoid and the electric motor relay energizing the motor.

4. The combination automatic garage door and security device of claim 3, wherein the electronics module further includes a timer element coupled to the solenoid relay.

5. The combination automatic garage door and security device of claim 4, wherein the timer element allows the motor to open the garage door before the solenoid is de-energized.

6. The combination garage door and security device of claim 1, wherein the locking assembly further comprises a housing fully enclosing the locking element, latching element, pivoting element, and solenoid.

7. A combination automatic garage door and security device for selectively securing and unsecuring a garage door to a support frame, the combination comprising:

a garage door;

a support frame supporting the garage door;

a locking assembly attached to one of said garage door and said frame, the locking assembly comprising:

a locking element having a detent;

a latching element, the latching element having a first end and a second end and being rotatable about an axis, the first end of the latching element being selectively engageable with the locking element, the latching element further comprising a manual release portion extending outwardly from the second end of the latching element; and an electronic solenoid having a pin, the pin being movable from a first position to a second position when the solenoid is activated, the length of the pin being greater when the pin is in its first position than when it is in its second position, the pin being coupled to the second end of the latching element;

a radio frequency receiver electrically coupled to the solenoid;

a securing element attached to the other one of said garage door and said frame; and a manual release member, the manual release member comprising a knob, the knob having a first end that contacts the manual release portion of the latching element;

wherein when the garage door is secured, the detent of the locking element is securely coupled with the securing element.

8. A combination automatic roll-down door and security device for selectively securing and unsecuring a roll-down door to a support frame, the combination comprising:

a roll-down door;

a support frame supporting the roll-down door;

a locking assembly attached to one of said roll-down door and said frame, the locking assembly comprising:

a locking element having a detent;

a latching element, the latching element having a first end and a second end and being rotatable about an axis, the first end of the latching element being selectively engageable with the locking element, the latching element further comprising a manual release portion extending outwardly from the second end of the latching element; and an electronic solenoid having a pin, the pin being movable from a first position to a second position when the solenoid is activated, the length of the pin being greater when the pin is in its first position than when it is in its second position, the pin being coupled to the second end of the latching element;

a radio frequency receiver electrically coupled to the solenoid;

a securing element attached to the other one of said roll-down door and said frame;

a motor element, the motor element being coupled with the garage door and moving the door from its closed position to its opened position and from its opened position to its closed position when activated; and a manual release member, the manual release member comprising a knob, the knob having a first end that contacts the manual release portion of the latching element;

wherein when the roll-down door is secured, the detent of the locking element is securely coupled with the securing element.

9. The combination automatic roll-down door and security device of claim 8, further including an electronics module coupled to the locking assembly, wherein the electronics module includes a solenoid relay, an electric motor relay, and the radio frequency receiver.

10. The combination automatic roll-down door and security device of claim 9, wherein the solenoid relay and the electric motor relay are adapted to be activated when a radio frequency transmitter sends a signal to the radio frequency receiver, the solenoid relay energizing the solenoid and the electric motor relay energizing the motor.

11. The combination automatic roll-down door and security device of claim 10, wherein the electronics module further includes a timer element coupled to the solenoid relay.

12. The combination automatic roll-down door and security device of claim 11, wherein the timer element allows the motor to open the roll-down door before the solenoid is de-energized.

13. The combination automatic roll-down door and security device of claim 8, wherein the locking element further comprises a housing fully enclosing the locking element, latching element, pivoting element, and solenoid.

14. A combination roll-down door and security device for selectively securing and unsecuring a roll-down door to a support frame, the combination comprising:

a roll-down door;

a support frame supporting the roll-down door;

a locking assembly attached to one of said roll-down door and said frame, the locking assembly comprising:

a locking element having a detent;

a latching element, the latching element having a first end and a second end and being rotatable about an axis, the first end of the latching element being selectively engageable with the locking element, the latching element further comprising a manual release portion extending outwardly from the second end of the latching element; and an electronic solenoid having a pin, the pin being movable from a first position to a second position when the solenoid is activated, the length of the pin being greater when the pin is in its first position than when it is in its second position, the pin being coupled to the second end of the latching element;

a radio frequency receiver electrically coupled to the solenoid;

a securing element attached to the other one of said roll-down door and said frame; and a manual release member, the manual release member comprising a knob, the knob having a first end that contacts the manual release portion of the latching element;

wherein when the roll-down door is secured, the detent of the locking element is securely coupled with the securing element.

15. A method for selectively securing and unsecuring a garage door from a support frame, the method comprising the steps of:

attaching a securing element to one of said garage door and said support frame;

attaching a locking assembly to the other one of said garage door and said support frame support frame of the locking assembly comprising:

a locking element having a detent, a first and second locking surface, and a first and second cam surface, the locking element being rotatable about an axis;

a latching element having a first end and a second end, the first end having a locking surface and a cam surface, the latching element being rotatable about an axis;

a solenoid having a pin coupled to the second end of the latching element;

providing an RF receiver, wherein the RF receiver is electrically connected to the solenoid;

providing an RF transmitter;

securing the garage door to the frame by moving the garage door to its closed position, causing the securing element to engage the detent of the locking element, causing the locking element to rotate about its axis, causing the first and second cam surfaces of the locking element to contact the cam surface of the latching element, causing the latching element to rotate about its axis, and causing the locking surface of the latching element to contact and engage the locking element; and unsecuring the garage door from the frame by activating the RF transmitter, causing the transmitter to send an RF signal to the RF receiver, causing the RF receiver to energize the solenoid to move the pin from a longer first position to a shorter second position, causing the latching element to rotate around its axis and disengage from the locking element, and allowing the locking element to disengage from and uncouple from the securing element.

16. The method of claim 15, further comprising the step of providing a motor to move the garage door from a closed to an opened position and from an opened position to a closed position, wherein the motor is energized to move the garage door from the closed position to the opened position when the RF transmitter is activated.

17. The method of claim 16, further comprising the step of providing a timer element coupled to the solenoid, wherein the timer element allows the motor to open the garage door before the solenoid is de-energized.

18. A method for selectively securing and unsecuring a roll-down door from a support frame, the method comprising the steps of:

attaching a securing element to the one of said roll-down door and support frame;

attaching a locking assembly to the support the other one of said roll-down door and support frame door, the locking assembly comprising:

a locking element having a detent, a first and second locking surface, and a first and second cam surface, the locking element being rotatable about an axis;

a latching element having a first end and a second end, the first end having a locking surface and a cam surface, the latching element being rotatable about an axis;

a solenoid having a pin coupled to the second end of the latching element;

providing an RF receiver, wherein the RF receiver is electrically connected to the solenoid;

providing an RF transmitter;

securing the roll-down door to the frame by moving the roll-down door to its closed position, causing the securing element to engage the detent of the locking element, causing the locking element to rotate about its axis, causing the first and second cam surfaces of the locking element to contact the cam surface of the latching element, causing the latching element to rotate about its axis, and causing the locking surface of the latching element to contact and engage the locking element; and unsecuring the roll-down door from the frame by activating the RF transmitter, causing the transmitter to send an RF signal to the RF receiver, causing the RF receiver to energize the solenoid to move the pin from a longer first position to a shorter second position, causing the latching element to rotate around its axis and disengage from the locking element, and allowing the locking element to disengage from and uncouple from the securing element.

19. The method of claim 18, further comprising the step of providing a motor to move the roll-down door from a closed to an opened position and from an opened position to a closed position, wherein the motor is energized to move the roll-down door from the closed position to the opened position when the RF transmitter is activated.

20. The method of claim 19, further comprising the step of providing a timer element coupled to the solenoid, wherein the timer element allows the motor to open the roll-down door before the solenoid is de-energized.

21. A method for selectively securing and unsecuring a garage door from a support frame, the method comprising the steps of:

attaching a securing element to the one of said garage door and said support frame;

attaching a locking assembly to the other one of said garage door and said support frame the locking assembly comprising:

a locking element having a detent, a first and second locking surface, and a first and second cam surface, the locking element being rotatable about an axis;

a latching element having a first end and a second end, the first end having a locking surface and a cam surface, the second end having a manual release portion extending outwardly from the second end of the latching element, the latching element being rotatable about an axis;

a solenoid having a pin coupled to the second end of the latching element;

providing a manual release member, comprising a knob having a first end that contacts the manual release portion of the latching element;

securing the garage door to the frame by moving the garage door to its closed position, causing the securing element to engage the detent of the locking element, causing the locking element to rotate about its axis, causing the first and second cam surfaces of the locking element to contact the cam surface of the latching element, causing the latching element to rotate about its axis, and causing the locking surface of the latching element to contact and engage the locking element; and unsecuring the garage door from the frame by moving the knob so that the first end of the knob moves in such a direction as to contact the manual release portion of the latching element, causing the latching element to rotate around its axis and disengage from the locking element, causing the locking element to disengage from and uncouple from the securing element.

22. A method for selectively securing and unsecuring a roll-down door from a support frame, the method comprising the steps of:

attaching a securing element to one of said roll-down door and said support frame;

attaching a locking assembly to the other one of said roll-down door and said support frame the locking assembly comprising:

a locking element having a detent, a first and second locking surface, and a first and second cam surface, the locking element being rotatable about an axis;

a latching element having a first end and a second end, the first end having a locking surface and a cam surface, the second end having a manual release portion extending outwardly from the second end of the latching element, the latching element being rotatable about an axis;

a solenoid having a pin coupled to the second end of the latching element;

providing a manual release member, the manual release member comprising a knob having a first end that contacts the manual release portion of the latching element;

securing the roll-down door to the frame by moving the roll-down door to its closed position, causing the securing element to engage the detent of the locking element, causing the locking element to rotate about its axis, causing the first and second cam surfaces of the locking element to contact the cam surface of the latching element, causing the latching element to rotate about its axis, and causing the locking surface of the latching element to contact and engage the locking element; and unsecuring the roll-down door from the frame by moving the knob so that the first end of the knob moves in such a direction as to contact the manual release portion of the latching element, causing the latching element to rotate around its axis and disengage from the locking element, and causing the locking element to disengage from and uncouple from the securing element.

* * * * *